US009918511B2

(12) United States Patent
Dua et al.

(10) Patent No.: US 9,918,511 B2
(45) **Date of Patent: *Mar. 20, 2018**

(54) ARTICLE OF FOOTWEAR HAVING A TEXTILE UPPER

(71) Applicant: NIKE, Inc., Beaverton, OR (US)

(72) Inventors: Bhupesh Dua, Portland, OR (US); Edward Nathaniel Thomas, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/664,587

(22) Filed: Jul. 31, 2017

(65) Prior Publication Data

US 2017/0325535 A1 Nov. 16, 2017

Related U.S. Application Data

(60) Continuation of application No. 15/610,089, filed on May 31, 2017, which is a continuation of application (Continued)

(51) Int. Cl.
*A43B 1/04* (2006.01)
*A43B 9/02* (2006.01)

(Continued)

(52) U.S. Cl.
CPC ..... *A43B 1/04* (2013.01); *A43B 7/085* (2013.01); *A43B 9/02* (2013.01); *A43B 23/021* (2013.01);

(Continued)

(58) Field of Classification Search
CPC ..... A43B 1/04; A43B 23/00; A43B 23/0205; A43B 23/0265; A43B 23/04; A43B 7/06; A43B 7/08; A43B 7/085

(Continued)

(56) References Cited

U.S. PATENT DOCUMENTS 601,192 A 3/1898 Woodside
761,520 A 5/1904 Matthew (Continued)

FOREIGN PATENT DOCUMENTS

DE 870963 3/1953
DE 1084173 6/1960

(Continued)

OTHER PUBLICATIONS

Burall, P., "CoID Design Awards", Design, Jun. 1969,4 pages.

(Continued)

*Primary Examiner* — Marie Bays
(74) *Attorney, Agent, or Firm* — Shook, Hardy & Bacon L.L.P.

(57) ABSTRACT

An article of footwear and a method of manufacturing the article of footwear are disclosed. The footwear may include an upper and a sole structure. The upper incorporates a textile element with edges that are joined together to define at least a portion of a void for receiving a foot. The textile element may have a first area with a first property and a second area with a second property. Various warp or weft knitting processes, including flat knitting, may be utilized to form the textile element.

20 Claims, 12 Drawing Sheets

Related U.S. Application Data

No. 14/503,514, filed on Oct. 1, 2014, now Pat. No. 9,743,705, which is a division of application No. 14/079,748, filed on Nov. 14, 2013, now abandoned, which is a continuation of application No. 13/413,233, filed on Mar. 6, 2012, now abandoned, which is a continuation of application No. 13/236,742, filed on Sep. 20, 2011, now Pat. No. 8,266,749, which is a continuation of application No. 12/879,517, filed on Sep. 10, 2010, now Pat. No. 8,042,288, which is a continuation of application No. 12/032,995, filed on Feb. 18, 2008, now Pat. No. 7,814,598, which is a division of application No. 10/791,289, filed on Mar. 3, 2004, now Pat. No. 7,347,011.

(51) Int. Cl.

| | |
|---|---|
| ***D04B 1/24*** | (2006.01) |
| ***A43B 23/02*** | (2006.01) |
| ***D04B 21/20*** | (2006.01) |
| ***D04B 1/10*** | (2006.01) |
| ***A43D 111/00*** | (2006.01) |
| ***A43B 7/08*** | (2006.01) |
| ***A43B 23/04*** | (2006.01) |

(52) U.S. Cl.

CPC ..... *A43B 23/0205* (2013.01); *A43B 23/028* (2013.01); *A43B 23/0215* (2013.01); *A43B 23/0235* (2013.01); *A43B 23/0275* (2013.01); *A43B 23/042* (2013.01); *A43D 111/00* (2013.01); *D04B 1/102* (2013.01); *D04B 1/24* (2013.01); *D04B 21/20* (2013.01); *D04B 21/207* (2013.01); *D10B 2501/043* (2013.01)

(58) Field of Classification Search

USPC ..... 36/45, 10, 55, 3 A, 84

See application file for complete search history.

(56) References Cited

U.S. PATENT DOCUMENTS

| | | | | | |
|---|---|---|---|---|---|
| 1,215,198 | A | | 2/1917 | Rothstein | |
| 1,597,934 | A | | 8/1926 | Stimpson | |
| 1,803,554 | A | | 5/1931 | Knilans | |
| 1,841,518 | A | * | 1/1932 | Bellak | D04B 1/24 36/11 |
| 1,888,172 | A | * | 11/1932 | Joha | A43B 1/02 36/11 |
| 1,902,780 | A | * | 3/1933 | Holden | D04B 1/26 36/55 |
| RE18,804 | E | | 4/1933 | Joha | |
| 1,910,251 | A | * | 5/1933 | Joha | D04B 1/24 12/142 S |
| 1,956,969 | A | | 5/1934 | Ayers | |
| 2,001,293 | A | | 5/1935 | Wilson | |
| 2,047,724 | A | * | 7/1936 | Zuckerman | D04B 1/24 36/11 |
| 2,147,197 | A | | 2/1939 | Glidden | |
| 2,150,730 | A | | 3/1939 | Schuessler | |
| 2,178,941 | A | | 11/1939 | Schuessler | |
| 2,314,098 | A | | 3/1943 | McDonald | |
| 2,330,199 | A | * | 9/1943 | Basch | D04B 1/106 2/80 |
| 2,343,390 | A | | 3/1944 | Ushakoff | |
| 2,400,692 | A | | 5/1946 | Herbert | |
| 2,440,393 | A | | 4/1949 | Clark | |
| 2,467,237 | A | * | 4/1949 | Sherman | A43B 1/04 12/114.6 |
| 2,569,764 | A | | 10/1951 | Jonas | |
| 2,586,045 | A | | 2/1952 | Hoza | |
| 2,603,891 | A | | 7/1952 | Cohn | |
| 2,608,078 | A | | 8/1952 | Anderson | |
| 2,641,004 | A | | 6/1953 | Whiting et al. | |
| 2,675,631 | A | | 4/1954 | Doughty | |
| 2,994,322 | A | | 8/1961 | Cullen et al. | |
| 3,114,213 | A | | 12/1963 | Bowers | |
| 3,583,081 | A | | 6/1971 | Hayashi | |
| 3,694,940 | A | | 10/1972 | Stohr | |
| 3,704,474 | A | | 12/1972 | Winkler | |
| 3,766,566 | A | | 10/1973 | Tadakoro | |
| 3,769,723 | A | * | 11/1973 | Masterson | A43B 5/02 36/128 |
| 3,778,856 | A | | 12/1973 | Christie et al. | |
| 3,863,272 | A | * | 2/1975 | Guille | A41B 11/007 12/142 G |
| 3,952,427 | A | | 4/1976 | Von den Benken et al. | |
| 3,972,086 | A | | 8/1976 | Belli et al. | |
| 3,985,003 | A | | 10/1976 | Reed | |
| 4,027,402 | A | | 6/1977 | Liu et al. | |
| 4,031,586 | A | | 6/1977 | Von den Benken et al. | |
| 4,038,840 | A | | 8/1977 | Castello | |
| 4,057,981 | A | | 11/1977 | Runac | |
| 4,151,662 | A | | 5/1979 | Vistins | |
| 4,172,293 | A | | 10/1979 | Vistins | |
| 4,183,156 | A | | 1/1980 | Rudy | |
| 4,211,806 | A | | 7/1980 | Civardi et al. | |
| 4,219,945 | A | | 9/1980 | Rudy | |
| 4,232,458 | A | | 11/1980 | Bartels | |
| 4,255,949 | A | | 3/1981 | Thorneburg | |
| 4,258,480 | A | | 3/1981 | Famolare, Jr. | |
| 4,317,292 | A | | 3/1982 | Melton | |
| 4,354,318 | A | | 10/1982 | Frederick et al. | |
| 4,373,361 | A | | 2/1983 | Thorneburg | |
| 4,438,574 | A | | 3/1984 | Johnson | |
| 4,447,967 | A | | 5/1984 | Zaino | |
| 4,465,448 | A | | 8/1984 | Aldridge | |
| 4,607,439 | A | | 8/1986 | Harada | |
| 4,624,115 | A | | 11/1986 | Safrit et al. | |
| 4,737,396 | A | | 4/1988 | Kamat | |
| 4,750,339 | A | | 6/1988 | Simpson et al. | |
| 4,756,098 | A | | 7/1988 | Boggia | |
| 4,785,558 | A | * | 11/1988 | Shiomura | A43B 1/04 36/114 |
| 4,813,158 | A | | 3/1989 | Brown | |
| 5,031,423 | A | | 7/1991 | Ikenaga | |
| 5,081,854 | A | | 1/1992 | Lonati | |
| 5,095,720 | A | | 3/1992 | Tibbals, Jr. | |
| 5,117,567 | A | | 6/1992 | Berger | |
| 5,152,025 | A | | 10/1992 | Himmas | |
| 5,192,601 | A | | 3/1993 | Neisler | |
| 5,343,639 | A | | 9/1994 | Kilgore et al. | |
| 5,345,638 | A | * | 9/1994 | Nishida | A41H 3/08 12/146 C |
| 5,353,523 | A | | 10/1994 | Kilgore et al. | |
| 5,353,524 | A | | 10/1994 | Brier | |
| 5,371,957 | A | | 12/1994 | Gaudio | |
| 5,461,884 | A | | 10/1995 | McCartney et al. | |
| 5,511,323 | A | | 4/1996 | Dahlgren | |
| 5,557,527 | A | | 9/1996 | Kotaki et al. | |
| 5,572,860 | A | | 11/1996 | Mitsumoto et al. | |
| 5,575,090 | A | | 11/1996 | Condini | |
| 5,604,997 | A | | 2/1997 | Dieter | |
| 5,623,840 | A | | 4/1997 | Roell | |
| 5,729,918 | A | | 3/1998 | Smets | |
| 5,735,145 | A | | 4/1998 | Pemick | |
| 5,746,013 | A | | 5/1998 | Fay, Sr. | |
| 5,765,296 | A | | 6/1998 | Ludemann et al. | |
| 5,884,419 | A | | 3/1999 | Davidowitz et al. | |
| 5,996,189 | A | | 12/1999 | Wang | |
| 6,029,376 | A | | 2/2000 | Cass | |
| 6,032,387 | A | | 3/2000 | Johnson | |
| 6,052,921 | A | | 4/2000 | Oreck | |
| 6,088,936 | A | | 7/2000 | Bahl | |
| 6,151,802 | A | | 11/2000 | Reynolds | |
| 6,170,175 | B1 | | 1/2001 | Funk | |
| 6,308,438 | B1 | * | 10/2001 | Throneburg | A43B 1/02 36/11 |
| 6,330,814 | B1 | | 12/2001 | Fujiwara | |
| 6,333,105 | B1 | | 12/2001 | Tanaka et al. | |
| 6,401,364 | B1 | | 6/2002 | Burt | |
| 6,482,492 | B1 | | 11/2002 | Hung | |

(56) References Cited

U.S. PATENT DOCUMENTS

| | | | | |
|---|---|---|---|---|
| 6,558,784 | B1 * | 5/2003 | Norton | A43B 5/002 12/146 C |
| 6,588,237 | B2 | 7/2003 | Cole et al. | |
| 6,754,983 | B2 | 6/2004 | Hatfield et al. | |
| 6,779,369 | B2 | 8/2004 | Shepherd | |
| 6,845,284 | B2 | 1/2005 | Bingham et al. | |
| 6,910,288 | B2 * | 6/2005 | Dua | A43B 1/04 12/146 C |
| 6,922,917 | B2 | 8/2005 | Kerns et al. | |
| 6,931,762 | B1 * | 8/2005 | Dua | A43B 1/04 12/142 G |
| 6,984,596 | B2 | 1/2006 | Dickerson | |
| 6,986,269 | B2 | 1/2006 | Dua | |
| D517,297 | S | 3/2006 | Jones et al. | |
| 7,051,460 | B2 | 5/2006 | Orei et al. | |
| 7,056,402 | B2 | 6/2006 | Koerwien et al. | |
| 7,347,011 | B2 * | 3/2008 | Dua | A43B 1/04 36/10 |
| 7,441,348 | B1 | 10/2008 | Dawson | |
| 7,543,397 | B2 | 6/2009 | Kilgore et al. | |
| 7,568,298 | B2 | 8/2009 | Kerns | |
| 7,682,219 | B2 | 3/2010 | Falla | |
| 7,814,598 | B2 * | 10/2010 | Dua | A43B 1/04 12/146 C |
| 8,042,288 | B2 * | 10/2011 | Dua | A43B 1/04 36/10 |
| 8,069,692 | B2 | 12/2011 | Chung et al. | |
| 8,266,749 | B2 * | 9/2012 | Dua | A43B 1/04 12/146 C |
| 8,490,299 | B2 | 7/2013 | Dua et al. | |
| 8,745,895 | B2 | 6/2014 | Sokolowski et al. | |
| 9,084,449 | B2 | 7/2015 | Bell et al. | |
| 2002/0078599 | A1 | 6/2002 | Delgorgue et al. | |
| 2002/0148258 | A1 | 10/2002 | Cole et al. | |
| 2003/0126762 | A1 | 7/2003 | Tseng | |
| 2003/0191427 | A1 | 10/2003 | Jay et al. | |
| 2004/0118018 | A1 * | 6/2004 | Dua | A43B 1/04 36/45 |
| 2004/0181972 | A1 | 9/2004 | Csorba | |
| 2005/0115284 | A1 | 6/2005 | Dua | |
| 2005/0193592 | A1 * | 9/2005 | Dua | A43B 1/04 36/45 |
| 2005/0273988 | A1 | 12/2005 | Christy | |
| 2005/0284000 | A1 | 12/2005 | Kerns | |
| 2006/0059715 | A1 | 3/2006 | Aveni | |
| 2006/0130359 | A1 | 6/2006 | Dua et al. | |
| 2006/0162187 | A1 | 7/2006 | Byrnes et al. | |
| 2007/0022627 | A1 | 2/2007 | Sokolowski et al. | |
| 2007/0180730 | A1 | 8/2007 | Greene et al. | |
| 2007/0294920 | A1 | 12/2007 | Baychar | |
| 2008/0017294 | A1 | 1/2008 | Bailey et al. | |
| 2008/0078102 | A1 | 4/2008 | Kilgore et al. | |
| 2008/0110048 | A1 | 5/2008 | Dua et al. | |
| 2008/0110049 | A1 | 5/2008 | Sokolowski et al. | |
| 2008/0189830 | A1 | 8/2008 | Egglesfield | |
| 2008/0313939 | A1 | 12/2008 | Ardill | |
| 2009/0068908 | A1 | 3/2009 | Hincholiff | |
| 2010/0051132 | A1 | 3/2010 | Glenn | |
| 2010/0154256 | A1 | 6/2010 | Dua | |
| 2010/0170651 | A1 | 7/2010 | Scherb et al. | |
| 2010/0199520 | A1 | 8/2010 | Dua et al. | |
| 2010/0287790 | A1 * | 11/2010 | Sokolowski | A43B 23/0235 36/47 |
| 2011/0030244 | A1 | 2/2011 | Motawi et al. | |
| 2011/0078921 | A1 | 4/2011 | Greene et al. | |
| 2012/0159813 | A1 | 6/2012 | Dua et al. | |
| 2012/0255201 | A1 | 10/2012 | Little | |
| 2013/0239625 | A1 | 9/2013 | Meir et al. | |
| 2014/0150294 | A1 | 6/2014 | Thomas et al. | |
| 2015/0013080 | A1 | 1/2015 | Thomas et al. | |
| 2016/0088893 | A1 | 3/2016 | Meir | |
| 2016/0088894 | A1 | 3/2016 | Meir et al. | |
| 2016/0208421 | A1 | 7/2016 | Baines et al. | |

FOREIGN PATENT DOCUMENTS

| | | |
|---|---|---|
| DE | 19738433 | 4/1998 |
| DE | 19728848 | 1/1999 |
| EP | 0448714 | 10/1991 |
| EP | 0728860 | 8/1996 |
| EP | 0758693 | 2/1997 |
| EP | 0279950 | 8/1998 |
| EP | 0898002 | 2/1999 |
| EP | 1233091 | 8/2002 |
| EP | 1437057 | 7/2004 |
| EP | 1563752 | 8/2005 |
| EP | 1602762 | 12/2005 |
| EP | 1972706 | 9/2008 |
| FR | 2171172 | 9/1973 |
| GB | 538865 | 8/1941 |
| GB | 2018837 | 10/1979 |
| GB | 1603487 | 11/1981 |
| JP | H06113905 | 4/1994 |
| JP | H08109553 | 4/1996 |
| JP | H11302943 | 11/1999 |
| NL | 7304678 | 10/1974 |
| WO | 9003744 | 4/1990 |
| WO | 0032861 | 6/2000 |
| WO | 0231247 | 4/2002 |

OTHER PUBLICATIONS

C.V. for Lenny M. Holden, 3 pages.

Textile Machinery—Knitting Machines—Nominal Diameters of Circular Machines, International Standard, ISO 8117, Second Edition, Feb. 15, 2003, 6 pages.

Petition for Inter-Partes Review Under 35 U.S. C. §§ 311-319 and 37 C.F.R. § 42.100 et seq. (IPR2016-00920), filed Apr. 19, 2016, 67 pages.

File History for U.S. Pat. No. 8,042,288, filed Apr. 19, 2016, as Exhibit 1002 in IPR2016-00920, 324 pages.

Declaration of Lenny M. Holden from the US Patent and Trademark Office Inter Partes Review IPR2016-00920 dated Apr. 19, 2016, 166 pages.

Form PTO SB 42 dated Apr. 19, 2016, in IPR2016-00920, 2 pages.

Notice of Filing Date accorded to Petition and Time for Filing Patent Owner Preliminary Response in IPR2016-00920 dated Apr. 25, 2016, 4 pages.

Patent Owner's Mandatory Notices in IPR2016-00920 dated May 10, 2016, 5 pages.

Trial Instituted Document in IPR2016-00920 dated Oct. 20, 2016, 8 pages.

Petition for Inter-Partes Review Under 35 U.S.C. §§ 311-319 and 37 C.F.R. § 42.100 et seq. (IPR2016-00921), filed Apr. 19, 2016, 57 pages.

File History for U.S. Pat. No. 7,814,598, filed Apr. 19, 2016, as Exhibit 1002 in IPR2016-00921, 346 pages.

Declaration of Lenny M. Holden from the US Patent and Trademark Office Inter Partes Review IPR2016-00921 dated Apr. 19, 2016, 154 pages.

Form PTO SB 42 dated Apr. 19, 2016, in IPR2016-00921, 2 pages.

Notice of Filing Date accorded to Petition and Time for Filing Patent Owner Preliminary Response in IPR2016-00921 dated Apr. 25, 2016, 4 pages.

Patent Owner's Mandatory Notices in IPR2016-00921 dated May 10, 2016, 5 pages.

Trial Instituted Document in IPR2016-00921 dated Oct. 21, 2016, 24 pages.

Scheduling Order in IPR2016-00921 dated Oct. 21, 2016, 9 pages.

Notice of Cross-Examination of Lenny M. Holden in IPR2016-00921 dated Dec. 19, 2016, 3 pages.

Petition for Inter-Partes Review Under 35 U.S.C. §§ 311-319 and 37 C.F.R. § 42.100 et seq. (IPR2016-00922), filed Apr. 19, 2016,67 pages.

File History for U.S. Pat. No. 8,266,749, filed Apr. 19, 2016, as Exhibit 1002 in IPR2016-00922, 309 pages.

Declaration of Lenny M. Holden from the US Patent and Trademark Office Inter Partes Review IPR2016-00922 dated Apr. 19, 2016, 154 pages.

(56) References Cited

OTHER PUBLICATIONS

Form PTO SB 42 dated Apr. 19, 2016, in IPR2016-00922, 2 pages.
Notice of Filing Date accorded to Petition and Time for Filing Patent Owner Preliminary Response in IPR2016-00922 dated Apr. 25, 2016, 4 pages.
Patent Owner's Mandatory Notices in IPR2016-00922 dated May 10, 2016, 5 pages.
Trial Instituted Document in IPR2016-00922 dated Oct. 21, 2016, 24 pages.
Scheduling Order in IPR2016-00922 dated Oct. 21, 2016, 9 pages.
Notice of Cross-Examination of Lenny M. Holden in IPR2016-00922 dated Dec. 19, 2016, 3 pages.
Petition for Inter-Partes Review Under 35 U.S.C. §§ 311-319 and 37 C.F.R. § 42.100 et seq. (IPR2017-00263), filed Nov. 14, 2016, 50 pages.
Declaration of Lenny M. Holden from the US Patent and Trademark Office Inter Partes Review IPR2017-00263 dated Nov. 14, 2016, 82 pages.
Form PTO SB 42 dated Nov. 14, 2016, in IPR2017-00263, 2 pages.
Patent Owner's Mandatory Notices in IPR2017-00263 dated Dec. 5, 2016, 5 pages.
Notice of Filing Date accorded to Petition and Time for Filing Patent Owner Preliminary Response in IPR2017-00263 dated Dec. 9, 2016, 5 pages.
Petition for Inter-Partes Review Under 35 U.S.C. §§ 311-319 and 37 C.F.R. § 42.100 et seq. (IPR2017-00264), filed Nov. 14, 2016, 59 pages.
Declaration of Lenny M. Holden from the US Patent and Trademark Office Inter Partes Review IPR2017-00264 dated Nov. 14, 2016, 106 pages.
Form PTO SB 42 dated Nov. 14, 2016, in IPR2017-00264, 2 pages.
Patent Owner's Mandatory Notices in IPR2017-00264 dated Dec. 5, 2016, 5 pages.
Notice of Filing Date accorded to Petition and Time for Filing Patent Owner Preliminary Response in IPR2017-00264 dated Dec. 9, 2016, 5 pages.
Declaration of Dr. Edward C. Frederick from the US Patent and Trademark Office Inter Partes Review of U.S. Pat. No. 7,347,011 (178 pp).
David J. Spencer, Knitting Technology: A Comprehensive Handbook and Practical Guide (Third ed., Woodhead Publishing Ltd. 2001) (413 pp).
Excerpt of Hannelore Eberle et al., Clothing Technology (Third English ed., Beuth-Verlag GmnH 2002) (book cover and back; pp. 2-3, 83).
File History for U.S. Pat. No. 7,347,011 (202 pgs.), filed Nov. 28, 2012, as Exhibit 1003 in IPR2013-00067.
IDS Under 37 C.F.R. 1.501 (2 pgs.), filed Nov. 28, 2012, as Exhibit 1004 in IPR2013-00067.
Notice of Filing Date accorded to Petition and Time for Filing Patent Owner Preliminary Response in IPR2013-00067 (8 pgs.), Dec. 4, 2012.
Petition for Inter Partes Review Under 35 U.S.C. §§ 311-319 and 37 C.F.R. § 42.100 et seq. (65 pgs.), filed Nov. 28, 2012, in IPR2013-00067.
Petitioner Power of Attorney dated Nov. 22, 2012 (2 pgs.), and filed Nov. 28, 2012, in IPR2013-00067.
Revised Petition for Inter Partes Review Under 35 U.S.C. §§ 311-319 and 37 C.F.R. § 42.100 et seq. (64 pgs.), filed Dec. 10, 2012, in IPR2013-00067.
List of Related Matters filed Dec. 14, 2012, in IPR2013-00067.
Mandatory Notice Information filed Jan. 25, 2013, in IPR2013-00067.
Submission of Power of Attorney filed Jan. 25, 2013, in IPR2013-00067.
Mandatory Notice Information filed Feb. 28, 2013, in IPR2013-00067.
Patent Owner's Preliminary Response to Petition filed Feb. 28, 2013, in IPR2013-00067.
Decision Institution of Inter Partes Review 37 C.F.R. § 42.108, entered May 17, 2013, in IPR2013-00067.
Scheduling Order dated May 17, 2013, in IPR2013-00067.
Notice of Stipulation dated Jun. 14, 2014, in IPR2013-00067.
Patent Owner's List of Proposed Motions dated Jun. 14, 2014, in IPR2013-00067.
Order—Conduct of the Proceeding dated Jun. 19, 2014, in IPR2013-00067.
Stipulation Regarding Discovery Relating to Expert Witness dated Jul. 11, 2013, in IPR2013-00067.
Motion to Authorize Withdrawal of Counsel and Appointment of New POA dated Jul. 11, 2013, in IPR2013-00067.
Petitioner Power of Attorney dated Jul. 11, 2013, in IPR2013-00067.
Notice of Cross Examination dated Jul. 11, 2013, in IPR2013-00067.
Final Written Decision dated Oct. 19, 2017 in IPR2016-00921 in U.S. Pat. No. 7,814,598, 49 pages.
Final Written Decision dated Oct. 19, 2017 in IPR2016-00922 in U.S. Pat. No. 8,266,749, 52 pages.
First Action Interview Office Action dated Oct. 13, 2017 in U.S. Appl. No. 15/650,488, 10 pages.
First Action Interview Preinterview Communication dated Oct. 20, 2017 in U.S. Appl. No. 15/703,394, 5 pages.
First Action Interview Preinterview Communication dated Oct. 20, 2017 in U.S. Appl. No. 15/703,583, 5 pages.
First Action Interview Office Action dated Nov. 14, 2017 in U.S. Appl. No. 15/684,608, 7 pages.
First Action Interview Office Action dated Nov. 16, 2017 in U.S. Appl. No. 15/610,011, 7 pages.
Decision Denying Institution of Inter Partes Review Under 37 C.F.R. § 42.108 for Inter Partes Review IPR2017-00263 dated Jun. 7, 2017, 11 pages.
Decision Denying Institution of Inter Partes Review Under 37 C.F.R. § 42.108 for Inter Partes Review IPR2017-00264 dated Jun. 7, 2017, 12 pages.
Patent Owner Nike Inc.'s Request for Oral Argument for Inter Partes Review IPR2016-00921 dated Jun. 12, 2017, 4 pages.
Petitioner's Request for Oral Argument for Inter Partes Review IPR2016-00921 dated Jun. 12, 2017, 4 pages.
Patent Owner Nike Inc.'s Request for Oral Argument for Inter Partes Review IPR2016-00922 dated Jun. 12, 2017, 4 pages.
Petitioner's Request for Oral Argument for Inter Partes Review IPR2016-00922 dated Jun. 12, 2017, 4 pages.
Order Oral Hearing Under 37 C.F.R. § 42.70 for Inter Partes Review IPR2016-00921 and for Inter Partes Review IPR2016-00922 dated Jun. 14, 2017, 6 pages.
Patent Owner Preliminary Response Under 37 C.F.R. § 42.107 for Inter Partes Review IPR2017-00263 dated Mar. 9, 2017, 24 pages.
Petition for Inter-Partes Review Under 35 U.S. C. §§ 311-319 and 37 C.F.R. § 42.100 et seq. (IPR2016-00920), filed Apr. 19, 2016, 67 pages, and submitted to the US Patent and Trademark Office on Mar. 9, 2017 as Exhibit 2001 to the Patent Owner Preliminary Response Under 37 C.F.R. § 42.107 dated Mar. 9, 2017 for Inter Partes Review IPR2017-00263 and for Inter Partes Review IPR2017-00264.
Trial Instituted Document in IPR2016-00920 dated Oct. 20, 2016, 8 pages, and submitted to the US Patent and Trademark Office on Mar. 9, 2017 as Exhibit 2002 to the Patent Owner Preliminary Response Under 37 C.F .R. § 42.107 dated Mar. 9, 2017 for Inter Partes Review IPR2017-00263 and for Inter Partes Review IPR2017-00264.
Petition for Inter-Partes Review Under 35 U.S. C. §§ 311-319 and 37 C.F.R. § 42.100 et seq. (IPR2017-00264), filed Nov. 14, 2016, 59 pages, and submitted to the US Patent and Trademark Office on Mar. 9, 2017 as Exhibit 2003 to the Patent Owner Preliminary Response Under 37 C.F .R. § 42.107 dated Mar. 9, 2017 for Inter Partes Review IPR2017-00263.
Patent Owner Corrected Preliminary Response Under 37 C.F.R. § 42.107 for Inter Partes Review IPR2017-00263 dated Mar. 27, 2017, 24 pages.

(56) References Cited

OTHER PUBLICATIONS

Patent Owner Updated Mandatory Notice Under 37 C.F.R. § 42.8 for Inter Partes Review IPR2017-00263 dated Mar. 28, 2017, 5 pages.
Patent Owner Preliminary Response Under 37 C.F.R. § 42.107 for Inter Partes Review IPR2017-00264 dated Mar. 9, 2017, 24 pages.
Petition for Inter-Partes Review Under 35 U.S. C. §§ 311-319 and 37 C.F.R. § 42.100 et seq. (IPR2017-00263), filed Nov. 14, 2016, 50 pages, and submitted to the US Patent and Trademark Office on Mar. 9, 2017 as Exhibit 2003 to the Patent Owner Preliminary Response Under 37 C.F .R. § 42.107 dated Mar. 9, 2017 for Inter Partes Review IPR2017-00264.
Patent Owner Corrected Preliminary Response Under 37 C.F.R. § 42.107 for Inter Partes Review IPR2017-00264 dated Mar. 27, 2017, 24 pages.
Patent Owner Updated Mandatory Notice Under 37 C.F.R. § 42.8 for Inter Partes Review IPR2017-00264 dated Mar. 28, 2017, 5 pages.
Office Action in corresponding U.S. Appl. No. 15/358,723, dated Apr. 5, 2017, 16 pages.
Declaration of Edward Frederick, Nov. 28, 2012.
Patent Owner's Trial Hearing Demonstratives, Feb. 6, 2014.
United States Court of Appeals for the Federal Circuit, Appeal docketed. Date received: Jun. 30, 2014.
Corrected Certified List from the United States Patent and Trademark Office, dated Aug. 25, 2014.
Motion of Appellant Nike, Inc. to Extend the Time to Dec. 15, 2014 to File the Appellant/Petitioner's Principal Brief, Sep. 17, 2014.
Order Granting Motion to Extend Time to File Appellant/Petitioner Principal Brief, Sep. 18, 2014.
Certificate of Compliance With Fed. Cir. R. 17 (Agency) for Appellant Nike, Inc., Sep. 23, 2014.
Certificate of Compliance With Fed. Cir. R. 17 (Agency) for Appellee Adidas AG, Sep. 25, 2014.
Tendered from Appellant Nike, Inc., Title: Opening Brief, Dec. 15, 2014.
Brief Filed for Appellant Nik, Inc., Dec. 15, 2014.
Motion of Director of the USPTO for Leave to Intervene, Dec. 18, 2014.
Motion of Appellee Adidas AG to Extend the Time to Apr. 10, 2015 to File the Appellee/Respondent/Cross-Appellant's Principal Brief, Dec. 18, 2015.
Order Granting Director's Motion for Leave to Intervene and Granting Motion to Extend Time to File Appellee's Response Brief, Sep. 29, 2014.
Tendered from Intervenor Lee. Title: Intervenor Brief, Apr. 9, 2015.
Brief Filed for Intervenor Lee, Apr. 9, 2015.
Tendered from Appellee Adidas AG. Title: Opening Brief, Apr. 10, 2015.
Motion of Appellant Nike, Inc. to Extend the Time to May 27, 2015 at 11:59 pm to File the Reply Brief, Apr. 13, 2015.
Order Granting Motion to Extend Time to File Reply Brief Filed by Appellant Nike, Inc., Apr. 14, 2015.
Tendered from Appellant Nike, Inc. Title: Reply Brief, May 27, 2015.
Tendered from Appellant Nike, Inc. Title: Joint Appendix, Jun. 8, 2015.
Statement of Compliance With Fed. Cir. R. 33 for Appellant Nike, Inc., Appellee, Adidas AG and Intervenor Lee, Jun. 8, 2015.
Appendix Filed for Nike, Inc., Jun. 8, 2015.
Citation of Supplemental Authority Pursuant to Fed. R. P. 280) for Appellant Nike, Inc., Aug. 24, 2015.
Motion of Intervenor Lee for Additional Time at Oral Argument, Sep. 3, 2015.
Order Filed Granting Motion to Seek More Time for Argument Filed by Intervenor Lee, Sep. 8, 2015.
Opinion and Judgment filed, Feb. 11, 2016.
Corrected Opinion and Judgment filed; Feb. 11, 2016.
Mandate Issued to the United States Patent and Trademark Office, Apr. 4, 2016.
Order-Conduct of Remand Proceeding, Aug. 10, 2016.
Petitioner Adidas AG's Notice of Supplemental Evidence in Response to Patent Owner's Objections to Evidence Under 37 C.F.R. § 42.64(8)(1) for Inter Partes Review IPR2016-00921 dated May 12, 2017, 4 pages.
Petitioner's Exhibit List (as of May 12, 2017) for Inter Partes Review IPR2016-00921, dated May 12, 2017, 4 pages.
Declaration of Tiffany L. Williams, and submitted to the US Patent and Trademark Office on May 12, 2017 as Exhibit 1015 to the Petitioner Adidas AG's Notice of Supplemental Evidence in Response to Patent Owner's Objections to Evidence Under 37 C.F.R. § 42.64(8)(1) for Inter Partes Review IPR2016-00921 dated May 12, 2017 and for Inter Partes Review IPR2016-00922.
Petitioner Adidas AG's Notice of Supplemental Evidence in Response to Patent Owner's Objections to Evidence Under 37 C.F.R. § 42.64(8)(1) for Inter Partes Review IPR2016-00922 dated May 12, 2017, 4 pages.
Petitioner's Exhibit List (as of May 12, 2017) for Inter Partes Review IPR2016-00922, dated May 12, 2017, 4 pages.
International Search Report and Written Opinion in connection with PCT/US2009/056795 dated Apr. 20, 2010.
International Search Report and Written Opinion in connection with PCT/US2012/028576 dated Oct. 1, 2012.
International Search Report and Written Opinion in connection with PCT/US2012/028559 dated Oct. 19, 2012.
International Search Report and Written Opinion in connection with PCT/US2012/028534 dated Oct. 17, 2012.
International Preliminary Report on Patentability in connection with PCT/US2012/028534 dated Sep. 17, 2013.
International Preliminary Report on Patentability in connection with PCT/US2012/028576 dated Sep. 17, 2013.
Pre-Interview First Office Action dated Jun. 22, 2017 in U.S. Appl. No. 15/610,089, 7 pages.
Pre-Interview First Office Action dated Aug. 16, 2017 in U.S. Appl. No. 15/646,835, 7 pages.
PreInterview First Office Action dated Aug. 16, 2017 in U.S. Appl. No. 15/650,499, 7 pages.
Preinterview First Office Action dated Aug. 17, 2017 in U.S. Appl. No. 15/664,650 7 pages.
Pre-Interview First Office Action dated Aug. 18, 2017 in U.S. Appl. No. 15/664,623, 9 pages.
Pre-Interview First Office Action dated Aug. 21, 2017 in U.S. Appl. No. 15/659,053, 7 pages.
Pre-Interview Office Action dated Aug. 7, 2017 in U.S. Appl. No. 15/650,488, 5 pages.
Decision Denying Petitioner's Request for Rehearing Under 37 C.F.R. § 42.71 for Inter Partes Review IPR2017-00263 and for Inter Partes Review IPR2017-0264, dated Jul. 20, 2017, 12 pages.
Record of Oral Hearing for Inter Partes Review IPR2016-00921 and for Inter Partes Review IPR2016-00922, dated Jul. 26, 2017, 74 pages.
Office Action dated Oct. 27, 2017 in U.S. Appl. No. 15/358,723, 11 pages.
Petitioner's Reply to Patent Owner's Response for Inter Partes Review IPR2016-00921 dated Apr. 21, 2017, 32 pages.
Petitioner's Updated Mandatory Notices Pursuant to 37 C.F.R. § 42.8 for Inter Partes Review IPR2016-00921, dated Apr. 21, 2017, 5 pages.
Koester, A.W., "Analyzing the Color, Design and Texture of Fabric", Oregon State University Extension Service, 1993, 8 pages, and submitted to the US Patent and Trademark Office on Apr. 21, 2017 as Exhibit 1013 to the Petitioner's Reply to Patent Owner's Response for Inter Partes Review IPR2016-00921 dated Apr. 21, 2017 and for Inter Partes Review IPR2016-00922.
"Definition of 'Impart'", Merriam-Webster, printed on Apr. 10, 2017 from the internet: hltgs://vvwvv.rnerriarn-webster.corn/diciionary/imQarl, 11 pages, and submitted to the US Patent and Trademark Office on Apr. 21, 2017 as Exhibit 1014 to the Petitioner's Reply to Patent Owner's Response for Inter Partes Review IPR2016-00921 dated Apr. 21, 2017 and for Inter Partes Review IPR2016-00922.

(56) References Cited

OTHER PUBLICATIONS

Patent Owner's Objections to Admissibility of Evidence Served With Petitioner's Reply to Patent Owner's Response Pursuant to 37 C.F.R. § 42.64(b) for Inter Partes Review IPR2016-00921 dated Apr. 28, 2017, 4 pages.
Petitioner's Reply to Patent Owner's Response for Inter Partes Review IPR2016-00922 dated Apr. 21, 2017, 34 pages.
Petitioner's Updated Mandatory Notices Pursuant to 37 C.F.R. § 42.8 for Inter Partes Review IPR2016-00922, dated Apr. 21, 2017, 5 pages.
Patent Owner's Objections to Admissibility of Evidence Served With Petitioner's Reply to Patent Owner's Response Pursuant to 37 C.F.R. § 42.64(b) for Inter Partes Review IPR2016-00922 dated Apr. 28, 2017, 4 pages.
Transcript of Declaration of Lenny M. Holden for Inter Partes Review IPR2016-00921 dated Jan. 10, 2017, 226 pages, and submitted to the US Patent and Trademark Office on Jan. 23, 2017 as Exhibit 2004 to the Patent Owner Response Under 37 C.F.R. § 42.120 dated Jan. 23, 2017 for Inter Partes Review IPR2016-00921 and for Inter Partes Review IPR2016-00922.
Patent Owner Response Under 37 C.F.R. § 42.120 for Inter Partes Review IPR2016-00921 dated Jan. 23, 2017, 64 pages.
Patent Owner Response Under 37 C.F.R. § 42.120 for Inter Partes Review IPR2016-00922 dated Jan. 23, 2017, 66 pages.
Order Trial Hearing dated Jan. 13, 2014, in IPR2013-00067.
Patent Owner Opposition to Motion to Exclude dated Jan. 21, 2014, in IPR2013-00067.
Order Conduct of the Proceeding § 42.5 dated Jan. 23, 2014, in IPR2013-00067.
Mandatory Notice Information (Addition of Back-Up Counsel) dated Jan. 28, 2014, in IPR2013-00067.
Petitioner's Reply to Patent Owner's Opposition to Petitioner's Motion to Exclude Evidence dated Jan. 28, 2014, in IPR2013-00067.
Petitioner's Exhibit List (As of Feb. 6, 2014) dated Feb. 6, 2014, in IPR2013-00067.
Submission of Patent Owner's Trial Hearing Demonstratives dated Feb. 6, 2014, in IPR2013-00067.
Oral Hearing Transcript dated Mar. 5, 2014, in IPR2013-00067.
Final Written Decision dated Apr. 28, 2014, in IPR2013-00067.
Notice of Appeal dated Jun. 30, 2014, in IPR2013-00067.
Cross Examination Deposition of Raymond Tonkel dated Nov. 12, 2013, in IPR2013-00067.
Declaration of Sabut Adanur Ph.D dated Nov. 12, 2013, in IPR2013-00067.
Excerpt of Knitted Fabrics dated Nov. 12, 2013, in IPR2013-00067.
Excerpt of Bharat J. Gaijar, Wrap Knit Fabrics Technologies dated Nov. 12, 2013, in IPR2013-00067.
J. Watel, the Milanese Machine: Little Progress Made in Development of Milanese Fabric dated Nov. 12, 2013, in IPR2013-00067.
Supplemental Declaration Edward C. Frederick, Ph.D. dated Nov. 12, 2013, in IPR2013-00067.
Billy Hunter, Editor Viewpoint: Nike Flyknit: Quantum Leap for Flat Knitting dated Nov. 12, 2013, in IPR2013-00067.
Billy Hunter, Editor Viewpoint: Nike Flyknit: Ready, Steady, Go dated Nov. 12, 2013, in IPR2013-00067.
Petitioner's Oral Hearing Demonstratives dated Feb. 6, 2014, in IPR2013-00067.
Edward C. Frederick, Ph.D Declaration dated Aug. 19, 2013, in IPR2013-00067.
Chapter 16 of Textiles in Sport dated Aug. 19, 2013, in IPR2013-00067.
U.S. Pat. No. 2,147,197 with markings dated Aug. 19, 2013, in IPR2013-00067.
U.S. Pat. No. 7,347,011 with markings dated Aug. 19, 2013, dated Aug. 19, 2013, in IPR2013-00067.
Decision on Appeal dated Aug. 19, 2013, in IPR2013-00067.
Edward C. Frederick, Ph.D Deposition Transcript dated Aug. 19, 2013, in IPR2013-00067.
Raymond F. Tonkel Declaration dated Aug. 19, 2013, in IPR2013-00067.
Excerpts from Man-Made Fiber and Textile Dictionary dated Aug. 19, 2013, in IPR2013-00067.
R-H Websters Dictionary Excerpt dated Aug. 19, 2013, in IPR2013-00067.
Edward C. Frederick, Ph.D Deposition Errata Sheet dated Aug. 29, 2013, in IPR2013-00067.
Exhibit 2015 dated Dec. 11, 2013, in IPR2013-00067.
Exhibit 2016 dated Dec. 11, 2013, in IPR2013-00067.
Exhibit 2017 dated Dec. 11, 2013, in IPR2013-00067.
Exhibit 2018 dated Dec. 11, 2013, in IPR2013-00067.
Exhibit 2020 dated Dec. 11, 2013, in IPR2013-00067.
Exhibit 2021 dated Dec. 11, 2013, in IPR2013-00067.
Exhibit 2022 dated Jan. 7, 2014, in IPR2013-00067.
Exhibit 2023 dated Jan. 7, 2014, in IPR2013-00067.
Exhibit 3001 dated Apr. 28, 2014, in IPR2013-00067.
Exhibit 3002 dated Apr. 28, 2014, in IPR2013-00067.
Form PTO SB 42 dated Nov. 28, 2012, in IPR2013-00067.
Form PTO SB 42 dated Nov. 12, 2013, in IPR2013-00067.
Order—Conduct of the Proceeding—37 CFR 42.5 dated Aug. 2, 2013, in IPR2013-00067.
Order—Case Transfer to Administrative Patent Judge Josiah C. Cocks dated Aug. 12, 2013, in IPR2013-00067.
Motion to Amend dated Aug. 19, 2013, in IPR2013-00067.
Patent Owner Exhibit List dated Aug. 19, 2013, in IPR2013-00067.
Corrected Certificate of Service dated Aug. 19, 2013, in IPR2013-00067.
NIKE Aug. 29, 2013 Ex List dated Aug. 29, 2013, in IPR2013-00067.
Decision Motion to Withdraw § 42.10(e) dated Oct. 30, 2013, in IPR2013-00067.
Petitioner adidas AG's Amended Notice of Cross Examination of Raymond Tonkel dated Nov. 1, 2013, in IPR2013-00067.
Petitioner Opposition to Patent Owner Motion to Amend dated Nov. 12, 2013, in IPR2013-00067.
Petitioner Exhibit List dated Nov. 12, 2013, in IPR2013-00067.
Patent Owner NIKE, Inc.'s Notice of Cross-Examination of Sabit Adanur dated Nov. 26, 2013, in IPR2013-00067.
Patent Owner NIKE, Inc.'s Notice of Second Cross Examination of Edward Frederick dated Nov. 26, 2013, in IPR2013-00067.
Submission of Power of Attorney dated Nov. 26, 2013, in IPR2013-00067.
Petitioner's Power of Attorney dated Nov. 26, 2013, in IPR2013-00067.
Mandatory Notice Information (Addition of Back-Up Counsel) dated Nov. 26, 2013, in IPR2013-00067.
Patent Owner's Reply to Petitioner's Opposition to Motion to Amend dated Dec. 11, 2013, in IPR2013-00067.
Patent Owner Exhibit List (Dec. 11, 2013) dated Dec. 11, 2013, in IPR2013-00067.
Patent Owner Exhibit List (as of Jan. 7, 2014) dated Jan. 7, 2014, in IPR2013-00067.
Patent Owner Request for Oral Argument dated Jan. 7, 2014, in IPR2013-00067.
Petitioner's Request for Oral Argument dated Jan. 7, 2014, in IPR2013-00067.
Petitioner's Motion to Exclude Evidence dated Jan. 7, 2014, in IPR2013-00067.
Petitioner Adidas AG's Request for Rehearing Under 37 C.F.R. § 42.71 on the Decision Not to Institute Inter Partes Review for Inter Partes Review IPR2017-00263, dated Jul. 7, 2017, 17 pages.
Petitioner Adidas AG's Request for Rehearing Under 37 C.F.R. § 42.71 on the Decision Not to Institute Inter Partes Review for Inter Partes Review IPR2017-00264, dated Jul. 7, 2017, 17 pages.
Petitioner's Demonstratives for Inter Partes Review IPR2016-00921, dated Jul. 10, 2017 and for Inter Partes Review IPR2016-00922, 84 pages.
Patent Owner NIKE's Exhibit List (As of Jul. 11, 2017) for Inter Partes Review IPR2016-00921, dated Jul. 11, 2017, 3 pages.

(56) References Cited

OTHER PUBLICATIONS

Petitioner's Updated Exhibit List (As of Jul. 11, 2017) for Inter Partes Review IPR2016-00921, dated Jul. 11, 2017, 4 pages.
Patent Owner NIKE Inc.'s Demonstratives for Inter Partes Review IPR2016-00921, dated Jul. 11, 2017 and for Inter Partes Review IPR2016-00922, 27 pages.
Patent Owner NIKE's Exhibit List (As of Jul. 11, 2017) for Inter Partes Review IPR2016-00922, dated Jul. 11, 2017, 3 pages.
Petitioner's Updated Exhibit List (As of Jul. 11, 2017) for Inter Partes Review IPR2016-00922, dated Jul. 11, 2017, 4 pages.
First Action Interview Preinterview Communication dated Sep. 1, 2017 in U.S. Appl. No. 15/610,011, 5 pages.
First Action Interview Preinterview Communication dated Sep. 7, 2017 in U.S. Appl. No. 15/609,971, 5 pages.
First Action Interview Preinterview Communication dated Sep. 15, 2017 in U.S. Appl. No. 15/684,608, 5 pages.
First Action Interview Office Action dated Sep. 29, 2017 in U.S. Appl. No. 15/609,971, 7 pages.
First Action Interview Office Action dated Oct. 10, 2017 in U.S. Appl. No. 15/664,650, 7 pages.
First Action Interview Office Action dated Oct. 16, 2017 in U.S. Appl. No. 15/650,499, 7 pages.
First Action Interview Office Action dated Oct. 18, 2017 in U.S. Appl. No. 15/659,053, 7 pages.
First Action Interview Office Action dated Oct. 18, 2017 in U.S. Appl. No. 15/664,623, 7 pages.
First Action Interview Office Action dated Oct. 18, 2017 in U.S. Appl. No. 15/646,835, 7 pages.
Notice of Allowance dated Aug. 8, 2017 in U.S. Appl. No. 15/610,089, 7 pages.
Notice of Allowance dated Oct. 27, 2017 in U.S. Appl. No. 15/610,089, 5 pages.

* cited by examiner

ARTICLE OF FOOTWEAR HAVING A TEXTILE UPPER

CROSS-REFERENCE TO RELATED APPLICATIONS

This application entitled "Article of Footwear Having A Textile Upper" is a continuation of and claims priority to U.S. patent application Ser. No. 15/610,089, filed May 31, 2017, which is a continuation of and claims priority to U.S. patent application Ser. No. 14/503,514, filed Oct. 1, 2014, which is a division of and claims priority to U.S. patent application Ser. No. 14/079,748, filed Nov. 14, 2013, which is a continuation of and claims priority to U.S. patent application Ser. No. 13/413,233, filed Mar. 6, 2012, which is a continuation application of and claims priority to U.S. patent application Ser. No. 13/236,742, filed Sep. 20, 2011, now U.S. Pat. No. 8,266,749, issued Sep. 18, 2012, which is a continuation application of and claims priority to U.S. patent application Ser. No. 12/879,517, filed Sep. 10, 2010, now U.S. Pat. No. 8,042,288, issued Oct. 25, 2011, which is a continuation application of and claims priority to U.S. patent application Ser. No. 12/032,995, filed Feb. 18, 2008, now U.S. Pat. No. 7,814,598, issued Oct. 19, 2010, which is a divisional application of and claims priority to U.S. patent application Ser. No. 10/791,289, filed Mar. 3, 2004, now U.S. Pat. No. 7,347,011, issued Mar. 25, 2008, each of which applications are being entirely incorporated herein by reference.

BACKGROUND

The present invention relates to footwear. The invention concerns, more particularly, an article of footwear incorporating an upper that is at least partially formed from a textile material.

DESCRIPTION OF BACKGROUND ART

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and the ground. In addition to attenuating ground reaction forces and absorbing energy (i.e., imparting cushioning), the sole structure may provide traction and control potentially harmful foot motion, such as over pronation. Accordingly, the upper and the sole structure operate cooperatively to provide a comfortable structure that is suited for a wide variety of ambulatory activities, such as walking and running. The general features and configuration of the conventional upper are discussed in greater detail below.

The upper forms a void on the interior of the footwear for receiving the foot. The void has the general shape of the foot, and access to the void is provided by an ankle opening. Accordingly, the upper extends over the instep and toe areas of the foot, along the medial and lateral sides of the foot, and around the heel area of the foot. A lacing system is often incorporated into the upper to selectively increase the size of the ankle opening and permit the wearer to modify certain dimensions of the upper, particularly girth, to accommodate feet with varying proportions. In addition, the upper may include a tongue that extends under the lacing system to enhance the comfort of the footwear, and the upper may include a heel counter to limit movement of the heel.

Various materials may be utilized in manufacturing the upper. The upper of an article of athletic footwear, for example, may be formed from multiple material layers that include an exterior layer, an intermediate layer, and an interior layer. The materials forming the exterior layer of the upper may be selected based upon the properties of wear-resistance, flexibility, and air permeability, for example. With regard to the exterior layer, the toe area and the heel area may be formed of leather, synthetic leather, or a rubber material to impart a relatively high degree of wear-resistance. Leather, synthetic leather, and rubber materials may not exhibit the desired degree of flexibility and air permeability. Accordingly, various other areas of the exterior layer of the upper may be formed from a synthetic or natural textile. The exterior layer of the upper may be formed, therefore, from numerous material elements that each impart different properties to specific portions of the upper.

An intermediate layer of the upper may be formed from a lightweight polymer foam material that provides cushioning and protects the foot from objects that may contact the upper. Similarly, an interior layer of the upper may be formed of a moisture-wicking textile that removes perspiration from the area immediately surrounding the foot. In some articles of athletic footwear, the various layers may be joined with an adhesive, and stitching may be utilized to join elements within a single layer or to reinforce specific areas of the upper.

Although the materials selected for the upper vary significantly, textile materials often form at least a portion of the exterior layer and interior layer. A textile may be defined as any manufacture from fibers, filaments, or yarns characterized by flexibility, fineness, and a high ratio of length to thickness. Textiles generally fall into two categories. The first category includes textiles produced directly from webs of filaments or fibers by randomly interlocking to construct non-woven fabrics and felts. The second category includes textiles formed through a mechanical manipulation of yarn, thereby producing a woven fabric, for example.

Yarn is the raw material utilized to form textiles in the second category. In general, yarn is defined as an assembly having a substantial length and relatively small cross-section that is formed of at least one filament or a plurality of fibers. Fibers have a relatively short length and require spinning or twisting processes to produce a yarn of suitable length for use in textiles. Common examples of fibers are cotton and wool. Filaments, however, have an indefinite length and may merely be combined with other filaments to produce a yarn suitable for use in textiles. Modern filaments include a plurality of synthetic materials such as rayon, nylon, polyester, and polyacrylic, with silk being the primary, naturally-occurring exception. Yarn may be formed of a single filament, which is conventionally referred to as a monofilament yarn, or a plurality of individual filaments grouped together. Yarn may also include separate filaments formed of different materials, or the yarn may include filaments that are each formed of two or more different materials. Similar concepts also apply to yarns formed from fibers. Accordingly, yarns may have a variety of configurations that generally conform to the definition provided above.

The various techniques for mechanically manipulating yarn into a textile include interweaving, intertwining and twisting, and interlooping. Interweaving is the intersection of two yarns that cross and interweave at right angles to each other. The yarns utilized in interweaving are conventionally referred to as warp and weft. Intertwining and twisting encompasses procedures such as braiding and knotting where yarns intertwine with each other to form a textile. Interlooping involves the formation of a plurality of columns of intermeshed loops, with knitting being the most common method of interlooping.

The textiles utilized in footwear uppers generally provide a lightweight, air-permeable structure that is flexible and comfortably receives the foot. In order to impart other properties to the footwear, including durability and stretch-resistance, additional materials are commonly combined with the textile, including leather, synthetic leather, or rubber, for example. With regard to durability, U.S. Pat. No. 4,447,967 to Zaino discloses an upper formed of a textile material that has a polymer material injected into specific zones to reinforce the zones against abrasion or other forms of wear. Regarding stretch resistance, U.S. Pat. No. 4,813,158 to Brown and U.S. Pat. No. 4,756,098 to Boggia both disclose a substantially inextensible material that is secured to the upper, thereby limiting the degree of stretch in specific portions of the upper.

From the perspective of manufacturing, utilizing multiple materials to impart different properties to an article of footwear may be an inefficient practice. For example, the various materials utilized in a conventional upper are not generally obtained from a single supplier. Accordingly, a manufacturing facility must coordinate the receipt of specific quantities of materials with multiple suppliers that may have distinct business practices or may be located in different regions or countries. The various materials may also require additional machinery or different assembly line techniques to cut or otherwise prepare the material for incorporation into the footwear. In addition, incorporating separate materials into an upper may involve a plurality of distinct manufacturing steps requiring multiple individuals. Employing multiple materials, in addition to textiles, may also detract from the breathability of footwear. Leather, synthetic leather, or rubber, for example, are not generally permeable to air. Accordingly, positioning leather, synthetic leather, or rubber on the exterior of the upper may inhibit air flow through the upper, thereby increasing the amount of perspiration, water vapor, and heat trapped within the upper and around the foot.

The present invention is an upper for an article of footwear, the upper incorporating a textile element formed with a knitting machine, for example. In one aspect of the invention, the textile element has edges that are joined together to define at least a portion of a void for receiving a foot. In another aspect of the invention, the textile element has a first area and a second area of unitary construction. The first area is formed of a first stitch configuration, and the second area is formed of a second stitch configuration that is different from the first stitch configuration to impart varying textures to a surface of the textile element. The knitting machine may have a configuration that forms the textile element through either warp knitting or weft knitting.

Another aspect of the invention involves a method of manufacturing an article of footwear. The method includes a step of mechanically manipulating a yarn with a circular knitting machine, for example, to form a cylindrical textile structure. In addition, the method involves removing at least one textile element from the textile structure, and incorporating the textile element into an upper of the article of footwear.

In another aspect of the invention, an article of footwear has an upper and a sole structure secured to the upper. The upper incorporates a textile element formed with a knitting machine. The textile element is removed from a textile structure that includes an outline of the textile element, and the textile element has edges that are joined together to define at least a portion of a void for receiving a foot.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

BRIEF DESCRIPTION OF THE DRAWINGS

The foregoing Summary of the Invention, as well as the following Detailed Description of the Invention, will be better understood when read in conjunction with the accompanying drawings.

DETAILED DESCRIPTION

The following discussion and accompanying figures disclose an article of footwear 10 and a method of manufacturing footwear 10, or components thereof, in accordance with the present invention. Footwear 10 is depicted in the figures and discussed below as having a configuration that is suitable for athletic activities, particularly running. The concepts disclosed with respect to footwear 10 may, however, be applied to footwear styles that are specifically designed for a variety of other athletic activities, including basketball, baseball, football, soccer, walking, and hiking, for example, and may also be applied to various non-athletic footwear styles. Accordingly, one skilled in the relevant art will recognize that the concepts disclosed herein may be applied to a wide range of footwear styles and are not limited to the specific embodiments discussed below and depicted in the figures.

Figure 1:
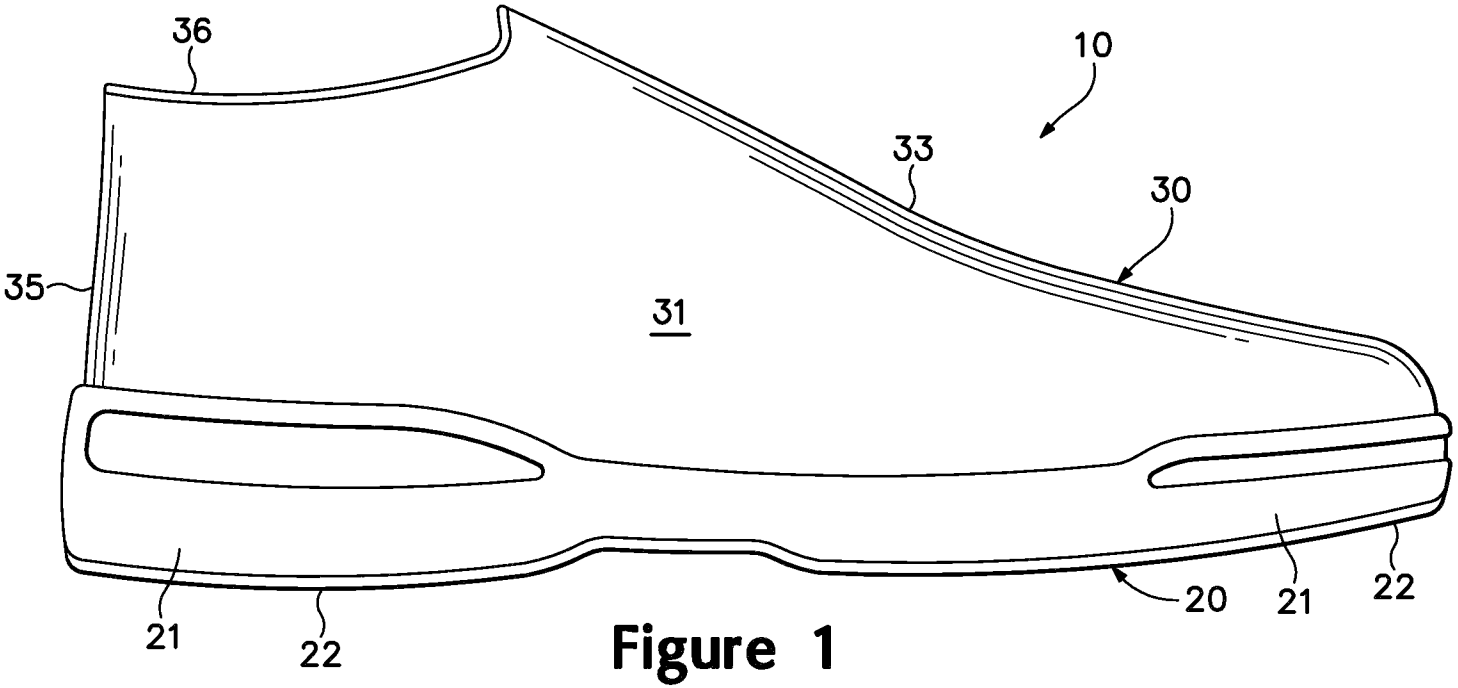
FIG. 1 is a lateral elevational view of an article of footwear having an upper in accordance with the present invention.
Figure 2:
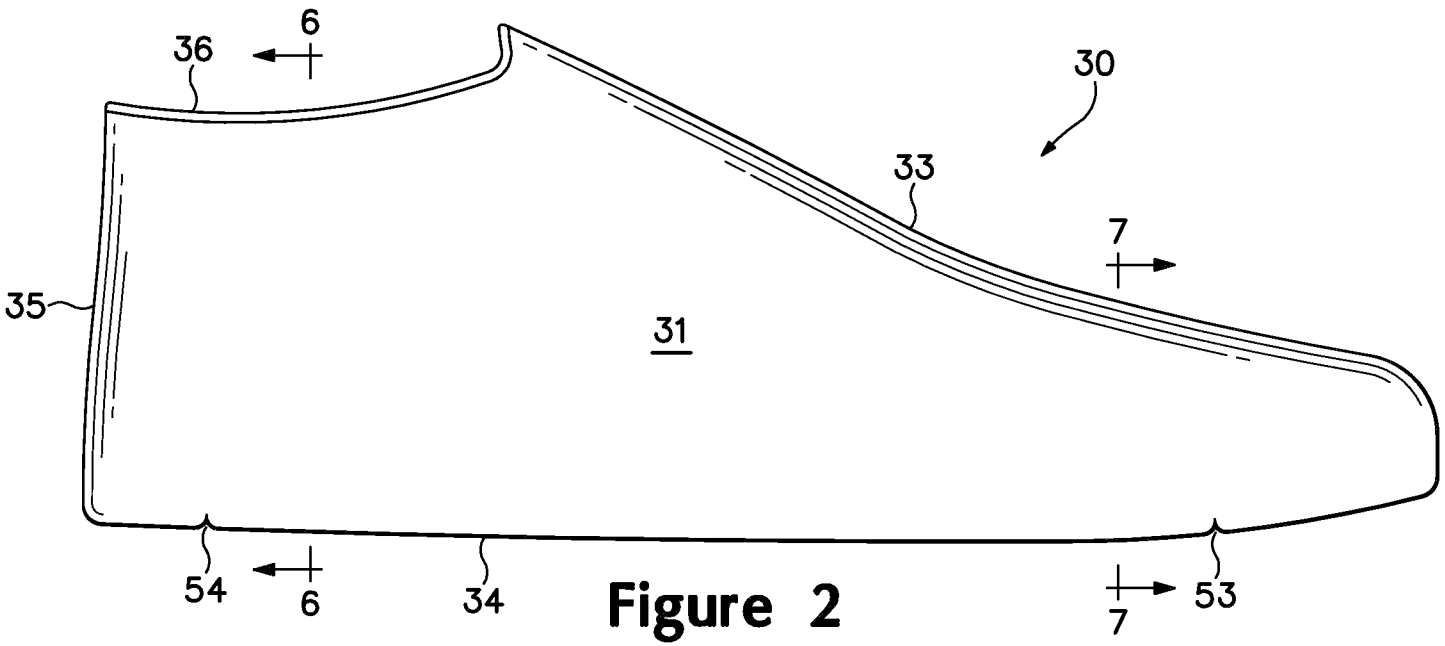
FIG. 2 is a lateral elevation view of the upper.
Figure 3:
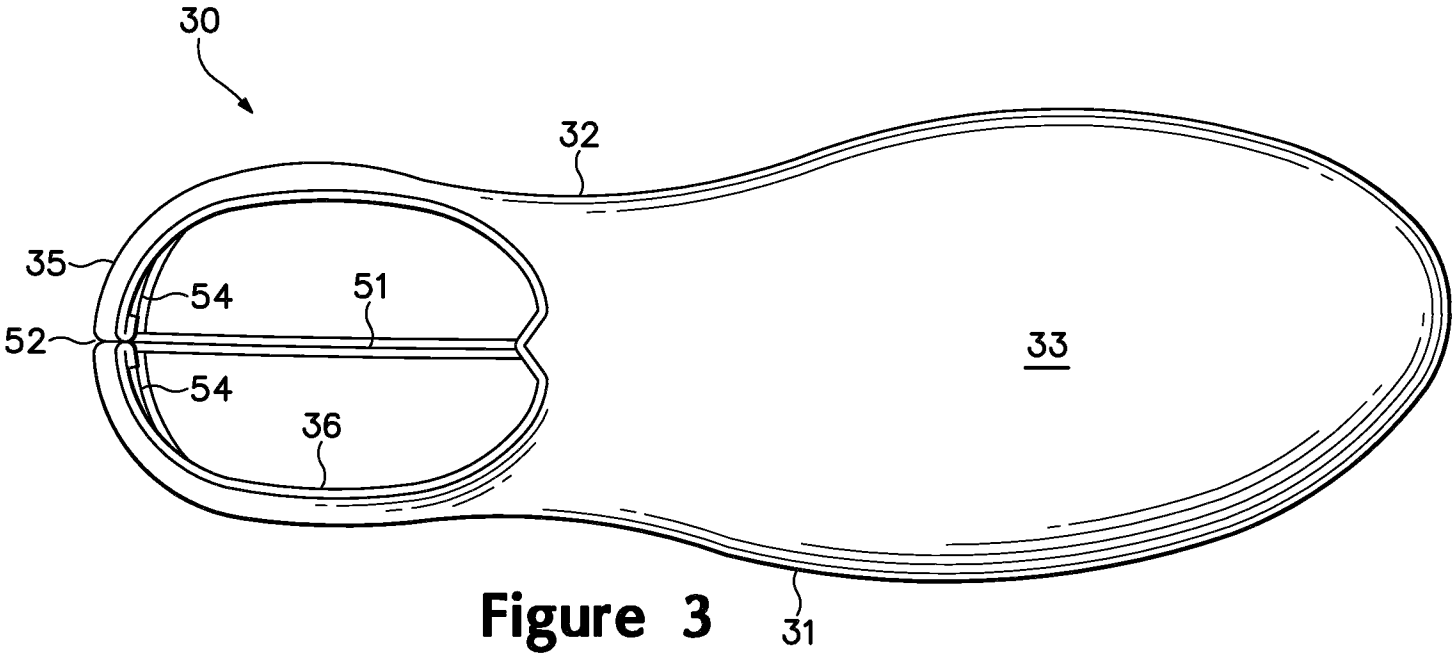
FIG. 3 is a top plan view of the upper.
Figure 4:
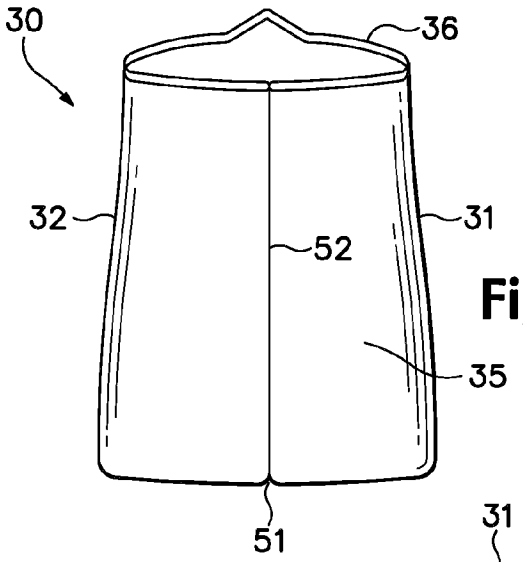
FIG. 4 is a rear elevational view of the upper.
Figure 5:
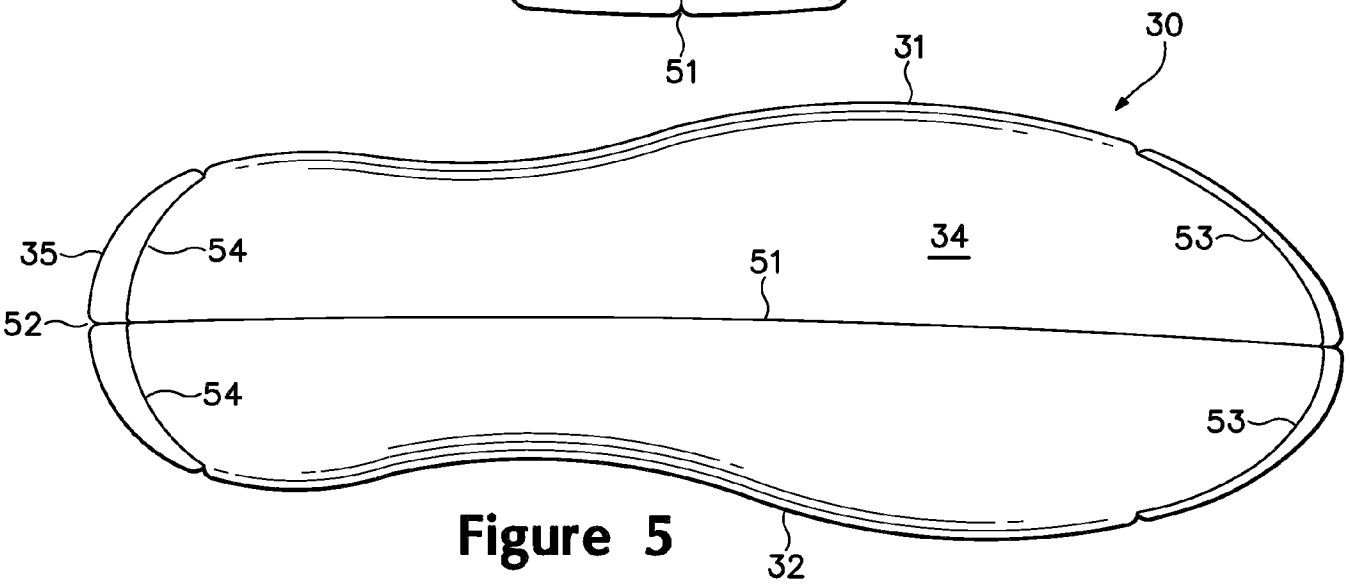
FIG. 5 is a bottom plan view of the upper.
Figure 6:
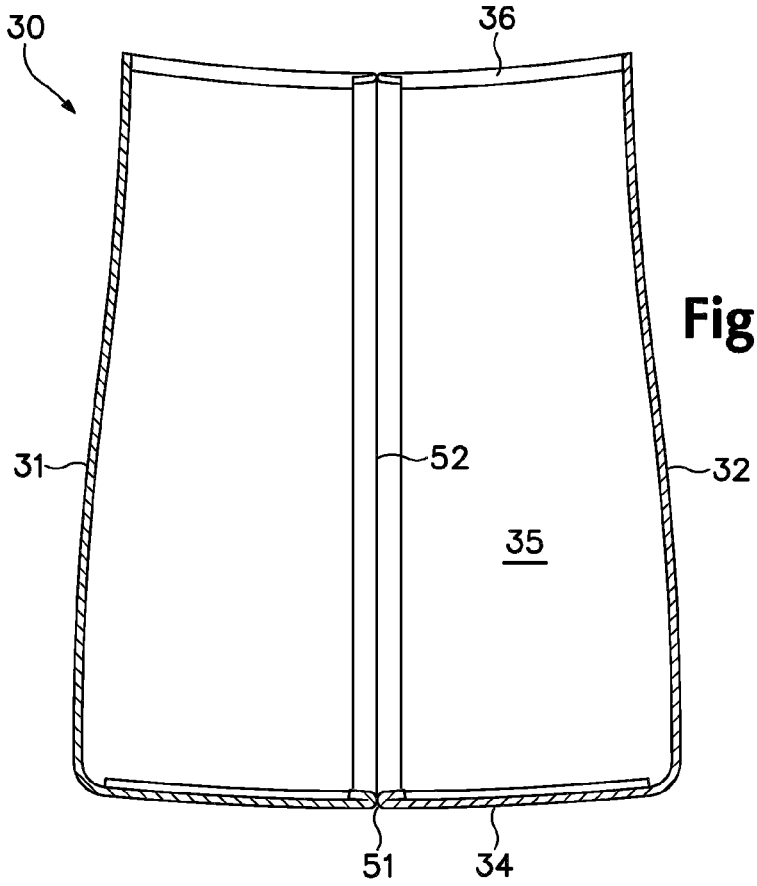
FIG. 6 is a first cross-sectional view of the upper, as defined by section line 6-6 in FIG. 2.
Figure 7:
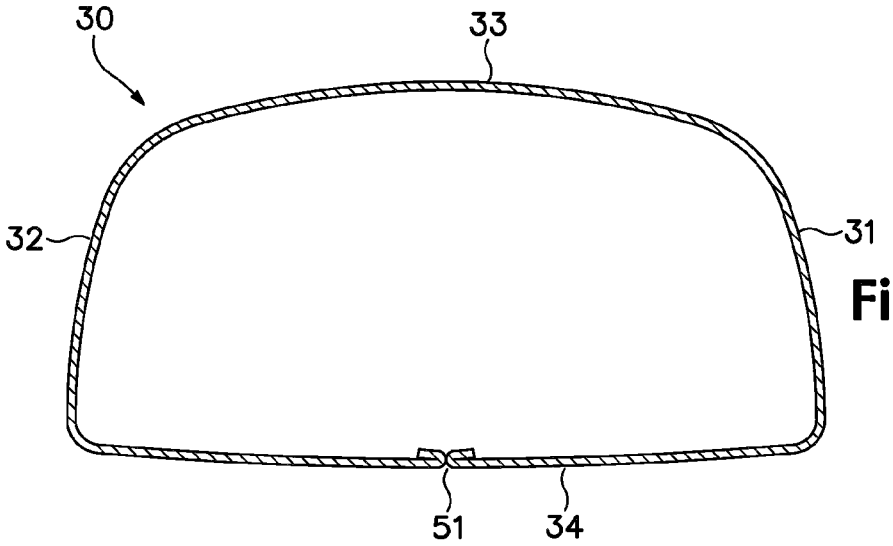
FIG. 7 is a second cross-sectional view of the upper, as defined by section line 7-7 in FIG. 2.

The primary elements of footwear 10 are depicted in FIG. 1 as being a sole structure 20 and an upper 30. Sole structure 20 is secured to a lower portion of upper 30 and provides a durable, wear-resistant component that imparts cushioning as footwear 10 impacts the ground. Upper 30 is at least partially formed from a textile element 40 that defines an interior void for comfortably receiving a foot and securing a position of the foot relative to sole structure 20. Various edges of textile element 40 are then secured together to form the shape of upper 30. In some embodiments, textile element 40 may form substantially all of upper 30, or textile element 40 may only be a portion of an upper.

Sole structure 20 has a generally conventional configuration that includes a midsole 21 and an outsole 22. Midsole 21 is secured to a lower portion of upper 30 and is formed of a polymer foam material, such as ethylvinylacetate or polyurethane. Accordingly, midsole 21 attenuates ground reaction forces and absorbs energy (i.e., provides cushioning) as sole structure 20 impacts the ground. To enhance the force attenuation and energy absorption characteristics of sole structure 20, midsole 21 may incorporate a fluid-filled bladder, as disclosed in U.S. Pat. Nos. 4,183,156 and 4,219,945 to Rudy. Alternately or in combination, midsole 21 may incorporate a plurality of discrete, columnar support elements, as disclosed in U.S. Pat. Nos. 5,343,639 and 5,353,523 to Kilgore et al. Outsole 22 is secured to a lower surface of midsole 21 and may be formed from carbon black rubber compound to provide a durable, wear-resistant surface for engaging the ground. Outsole 22 may also incorporate a textured lower surface to enhance the fraction characteristics of footwear 10. In addition, footwear 10 may include an insole (not depicted), which is a relatively thin, cushioning member located within upper 30 and adjacent to a plantar surface of the foot for enhancing the comfort of footwear 10.

Sole structure 20 is described above as having the elements of a conventional sole structure for athletic footwear. Other footwear styles, including, dress shoes and boots, for example, may have other types of conventional sole structures specifically tailored for use with the respective types of footwear. In addition to a conventional configuration, however, sole structure 20 may also exhibit a unique, non-conventional structure. Accordingly, the particular configuration of sole structure 20 may vary significantly within the scope of the present invention to include a wide range of configurations, whether conventional or non-conventional.

Upper 30 is depicted in FIGS. 2-7 as having a lateral region 31, an opposite medial region 32, an instep region 33, a lower region 34, and a heel region 35. Lateral region 31 extends through a longitudinal length of footwear 10 and is generally configured to contact and cover a lateral side of the foot. Medial region 32 has a similar configuration that generally corresponds with a medial side of the foot. Instep region 33 is positioned between lateral region 31 and medial region 32, and instep region 33 extends over an instep area of the foot. Lower region 34 forms a bottom surface of upper 30 and also extends through the longitudinal length of footwear 10. Heel region 35 forms a rear portion of upper 30 and is generally configured to contact and cover a heel area of the foot. In addition, lateral region 31, medial region 32, instep region 33, and heel region 35 cooperatively define an ankle opening 36 for providing the foot with access to the void within upper 30.

Upper 30 is at least partially formed from textile element 40, which forms regions 31-35, and may also include laces or other elements associated with a conventional upper for footwear. Textile element 40 is a single material element that is formed to exhibit a unitary (i.e., one-piece) construction, and textile element 40 is formed or otherwise shaped to extend around the foot. As depicted in FIGS. 2-7, textile element 40 forms both an exterior surface and an interior surface of upper 30. Textile element 40 may be formed as a part of a larger textile element. Textile element 40 is then removed from the larger textile element and various edges of textile element 40 are secured together to form the shape of upper 30. A plurality of seams 51-54 are formed, therefore, when joining the edges of the textile element. Seam 51 extends along the longitudinal length of lower region 34 and is centrally-located with respect to lateral region 31 and medial region 32. Seam 52 is also centrally-located and extends upward along heel region 35. A seam 53 is positioned in a forefoot area of upper 30 and joins a portion of lower region 34 with both of lateral region 31 and medial region 32. In addition, a seam 54 is positioned in a rear area of upper 30 and joins a portion of lower region 34 with heel region 35.

Figure 8:
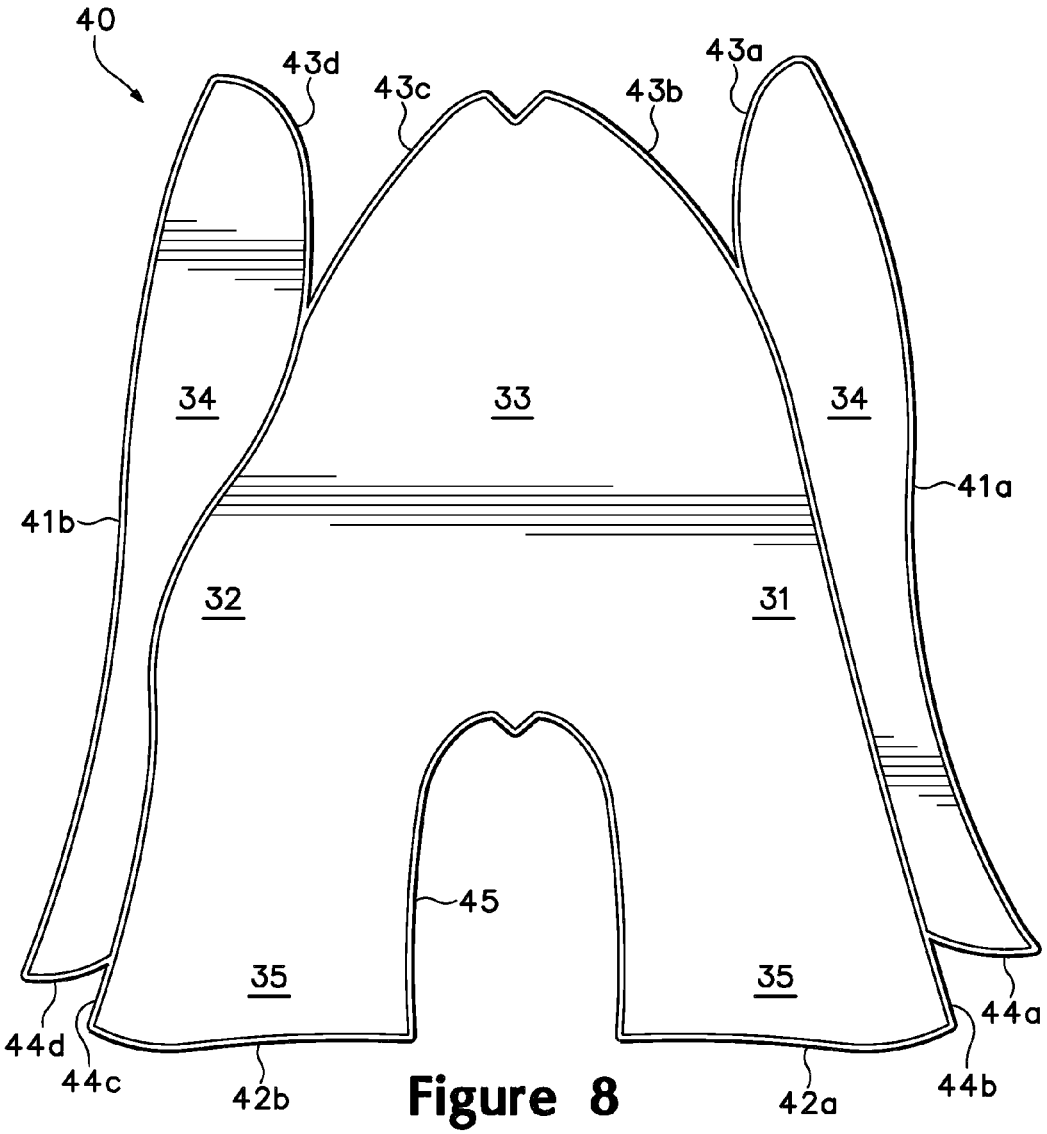
FIG. 8 is a plan view of a textile element that forms at least a portion of the upper.

Textile element 40 exhibits the general shape depicted in FIG. 8 prior to the formation of seams 51-54. Following formation of seams 51-54, however, textile element 40 exhibits the shape of upper 30 depicted in FIGS. 2-7. Seams 51-54 are formed by securing various edges of textile element 40 together. More specifically, (1) seam 51 is formed by securing an edge 41 a with an edge 41*b*; (2) seam 52 is formed by securing an edge 42*a* with an edge 42*b*; (3) a first portion of seam 53 is formed by securing an edge 43*a* with an edge 43*b*; (4) a second portion of seam 53 is formed by securing an edge 43*c* with an edge 43*d*; (5) a first portion of seam 54 is formed by securing an edge 44*a* with an edge 44*b*; and (6) a second portion of seam 54 is formed by securing an edge 44*c* with an edge 44*d*. Referring to FIG. 8, the positions of regions 31-35 and ankle opening 36 are identified to provide a frame of reference relating to the various portions of textile element 40.

In order to join edges 41*a* and 41*b* to form seam 51, textile element 40 is folded or otherwise overlapped such that edge 41*a* is placed adjacent to edge 41*b*. Stitching, an adhesive, or heat bonding, for example, is then utilized to secure edge 41*a* and edge 41*b*. Textile element 40, as depicted in FIG. 8, has a generally planar configuration. Upon the formation of seam 51, however, one portion of textile element 40 overlaps the other portion of textile element 40. The volume between the overlapping portions effectively forms a portion of the void within upper 30 for receiving the foot.

The folding or overlapping of textile element 40 to form seam 51 places edge 42*a* adjacent to edge 42*b*, which facilitates the formation of seam 52. With reference to FIG. 8, an edge 45 forms a generally u-shaped area in textile element 40. Upon the joining of edges 42*a* and 42*b* to form seam 52, the u-shaped area becomes an aperture in textile element 40 and effectively forms ankle opening 36. Each of edges 43*a*-43*d* and edges 44*a*-44*d* are formed from a generally v-shaped area of textile element 40. Accordingly, seams 53 and 54 may be formed by closing the v-shaped areas and securing the various edges together.

Following the formation of each of seams 51-54, the manufacturing of upper 30 is essentially complete. Various finishing steps may be performed, such as reinforcing ankle opening 36, for example. Upper 30 (i.e., textile element 40) is then secured to sole structure 20, with an adhesive, for example. The insole is then placed into the void within upper 30 and adjacent to lower region 34. In some embodiments, various reinforcing members may be added to the exterior or interior surface of upper 20 in order to limit the degree of stretch in upper 20 or provide enhanced wear-resistance. In addition, a lacing system may be added to provide adjustability.

Textile element 40 is a single material element with a unitary construction, as discussed above. As defined for purposes of the present invention, unitary construction is intended to express a configuration wherein portions of a textile element are not joined together by seams or other connections, as depicted with textile element 40 in FIG. 8. Although the various edges 41*a*-44*d* are joined together to form seams 51-54, the various portions of textile element 40 are formed as an unitary element without seams, as discussed below.

Textile element 40 is primarily formed from one or more yarns that are mechanically-manipulated through either an interweaving, intertwining and twisting, or interlooping process, for example. As discussed in the Background of the Invention section above, interweaving is the intersection of two yarns that cross and interweave at right angles to each other. The yarns utilized in interweaving are conventionally referred to as warp and weft. Intertwining and twisting encompasses procedures such as braiding and knotting where yarns intertwine with each other to form a textile. Interlooping involves the formation of a plurality of columns of intermeshed loops, with knitting being the most common method of interlooping. Textile element 40 may, therefore, be formed from one of these processes for manufacturing a textile.

A variety of mechanical processes have been developed to manufacture a textile. In general, the mechanical processes may be classified as either warp knitting or weft knitting. With regard to warp knitting, various specific sub-types that may be utilized to manufacture a textile include tricot, raschel, and double needle-bar raschel (which further includes jacquard double needle-bar raschel). With regard to weft knitting, various specific sub-types that may be utilized to manufacture a textile include circular knitting and flat knitting. Various types of circular knitting include sock knitting (narrow tube), body garment (seamless or wide tube), and jacquard.

Textile element 40 may be formed through any of the mechanical processes discussed above. Accordingly, textile element 40 may be formed on either a warp knitting machine or a weft knitting machine. One suitable knitting machine for forming textile element 40 is a wide-tube circular knit jacquard machine. Another suitable knitting machine for forming textile element 40 is a wide-tube circular knitting machine that is produced in the Lonati Group by Santoni S.p.A. of Italy under the SM8 TOP1 model number. This Santoni S.p.A. wide-tube circular knitting machine may form a textile structure having a diameter that ranges from 10 inches to 20 inches, with 8 feeds for each diameter. The machine exhibits a maximum 140 revolutions per minute for 10 inch diameters, and a maximum 120 revolutions per minute for 13 inch diameters. Furthermore, the machine gauge is variable between 16, 22, 24, 26, 28, and 32 needles per inch, and is suitable for various needle gauges ranging from 48 to 75.

A wide-tube circular knitting machine, as produced by Santoni S.p.A., forms a generally cylindrical textile structure and is capable of forming various types of stitches within a single textile structure. In general, the wide-tube circular knitting machine may be programmed to alter the design on the textile structure through needle selection. That is, the type of stitch that is formed at each location on the textile structure may be selected by programming the wide-tube circular knitting machine such that specific needles either accept or do not accept yarn at each stitch location. In this manner, various patterns, textures, or designs may be selectively and purposefully imparted to the textile structure.

Figure 9:
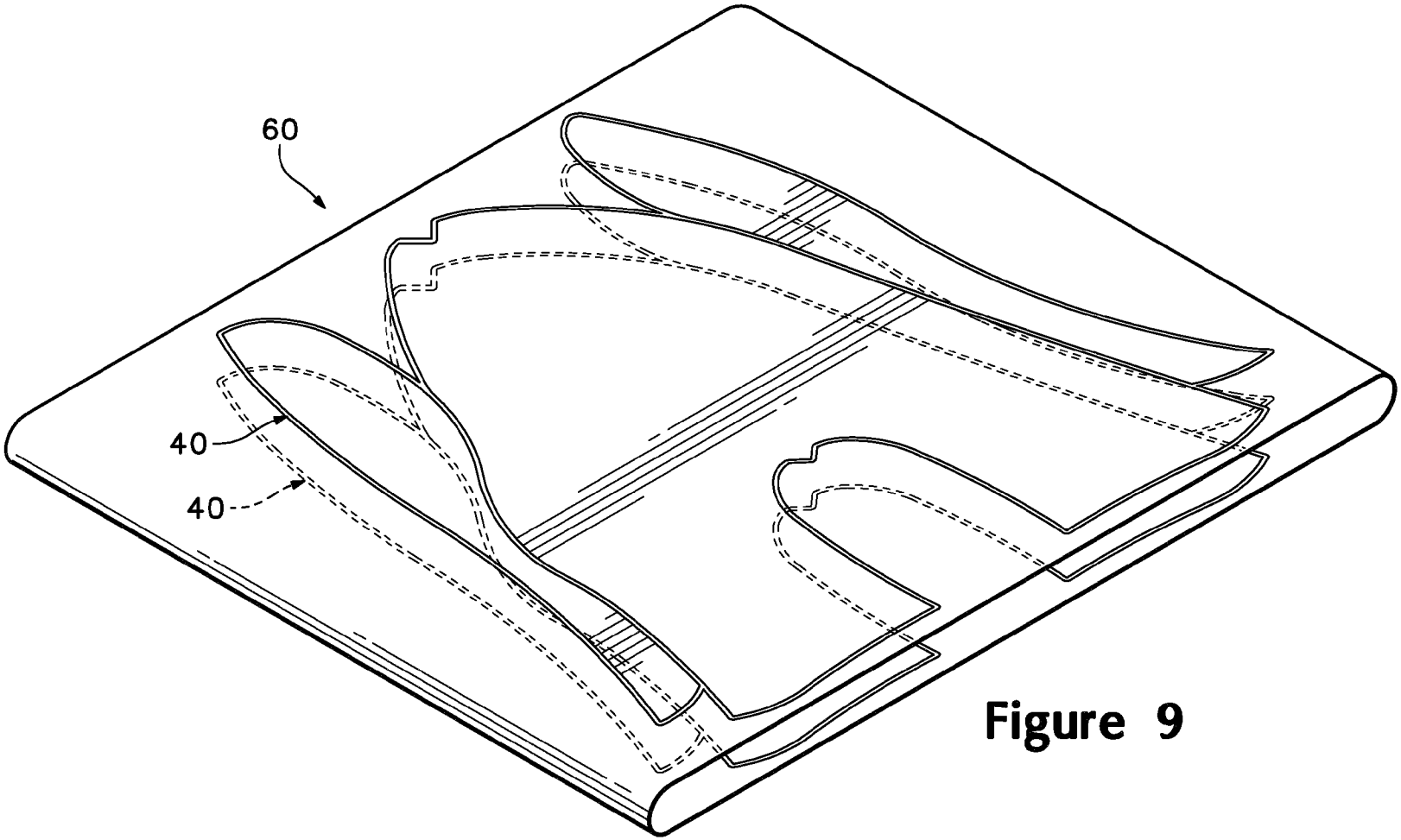
FIG. 9 is a perspective view of a textile structure that incorporates two of the textile element.

An example of a textile structure 60 that may be formed with a wide-tube circular knitting machine is depicted in FIG. 9. Textile structure 60 has a generally cylindrical configuration, and the types of stitches vary throughout textile structure 60 so that a pattern is formed with the outline of textile element 40. That is, differences in the stitches within textile structure 60 form an outline with the shape and proportions of textile element 40.

The Santoni S.p.A. wide-tube circular knitting machine may form a textile structure having a diameter that ranges from 10 inches to 16 inches, as discussed above. Assuming that textile structure 60 exhibits a diameter of 10 inches, then the circumference of textile structure 60 is approximately 31 inches. In many circumstances, the total width of textile element 40 will be approximately 12 inches, depending upon the size of footwear 10. The outlines for at least two textile elements 40 may, therefore, be formed on textile structure 60. Referring to FIG. 9, the outline of textile element 40 is depicted on a front portion of textile structure 60, and the outline of another textile element 40 is depicted on a rear portion of textile structure 60. Accordingly, a first textile element 40 and a second textile element 40 may be simultaneously formed in a single textile structure 60. As the diameter of textile element 60 is increased or the width of textile element 40 decreases, however, an even greater number of textile elements 40 may be outlined on textile structure 60.

Textile structure 60 may be formed with a wide-tube circular knitting machine, as discussed above. The types of stitches that form textile structure 60 may be varied to form an outline of one or more textile elements 40 on textile structure 60. That is, the wide-tube circular knitting machine may be programmed to form different types of stitches in textile structure 60 so as to outline one or more textile elements 40. Each textile element 40 is then removed from textile structure 60 with a die-cutting, laser-cutting, or other conventional cutting operation. Once textile element 40 is removed from textile structure 60, seams 51-54 may be formed and textile element 40 may be incorporated into footwear 10.

The yarn forming textile element 40 may be generally defined as an assembly having a substantial length and relatively small cross-section that is formed of at least one filament or a plurality of fibers. Fibers have a relatively short length and require spinning or twisting processes to produce a yarn of suitable length for use in an interlooping process. Common examples of fibers are cotton and wool. Filaments, however, have an indefinite length and may merely be combined with other filaments to produce a yarn suitable for use in an interloping process. Modern filaments include a plurality of synthetic materials such as rayon, nylon, polyester, and acrylic, with silk being the primary, naturally-occurring exception. Yarn may be formed of a single filament (conventionally referred to as a monofilament yarn) or a plurality of individual filaments. Yarn may also be formed of separate filaments formed of different materials, or the yarn may be formed of filaments that are each formed of two or more different materials. Similar concepts also apply to yarns formed from fibers. Accordingly, yarns may have a variety of configurations within the scope of the present invention that generally conform to the definition provided above.

In order to provide the stretch and recovery properties to upper 30, and particularly textile element 40, a yarn that incorporates an elastane fiber may be utilized. Elastane fibers are available from E.I. DuPont de Nemours Company under the LYCRA trademark. Such fibers may have the configuration of covered LYCRA, wherein the fiber includes a LYCRA core that is surrounded by a nylon sheath. One suitable yarn, for example, includes a 70 denier elastane core that is covered with nylon having a 2 ply, 80 denier, 92 filament structure. Other fibers or filaments exhibiting elastic properties may also be utilized.

As discussed above, a yarn that incorporates elastane fibers is suitable for textile element 40. A plurality of other yarns, whether elastic or inelastic, are also suitable for textile element 40. The characteristics of the yarn selected for textile element 40 depend primarily upon the materials that form the various filaments and fibers. Cotton, for example, provides a soft hand, natural aesthetics, and biodegradability. Elastane fibers, as discussed above, provide substantial stretch and recoverability. Rayon provides high luster and moisture absorption. Wool also provides high moisture absorption, in addition to insulating properties. Polytetrafluoroethylene coatings may provide a low friction contact between the textile and the skin. Nylon is a durable and abrasion-resistant material with high strength. Finally, polyester is a hydrophobic material that also provides relatively high durability. Accordingly, the materials comprising the yarn may be selected to impart a variety of physical properties to textile element 40, and the physical properties may include, for example, strength, stretch, support, stiffness, recovery, fit, and form.

Figure 10:
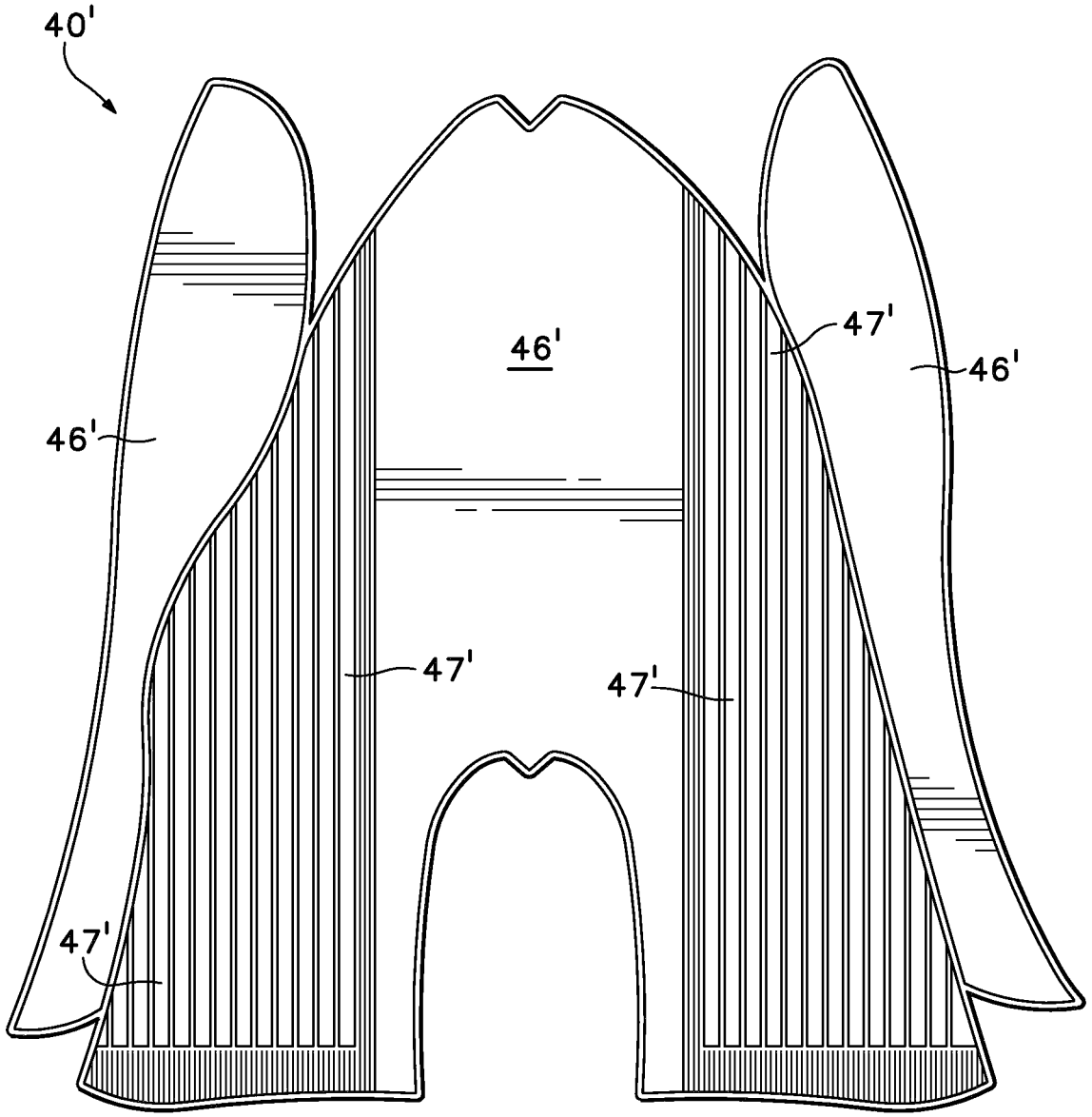
FIG. 10 is a plan view of another textile element.

Textile element 40 is depicted as having a generally smooth, non-varied stitch configuration. That is, similar stitches are utilized throughout textile element 40 to impart a common texture to the various portions of textile element 40. As discussed above, however, a wide-tube circular knitting machine is generally capable of forming various types of stitches within a single textile structure. The wide-tube circular knitting machine may, therefore, vary the stitches within textile element 40 to produce various patterns, designs, or textures, for example. Various types of stitches may also be formed with other types of knitting machines. With reference to FIG. 10, a textile element 40' with the general shape of textile element 40 is depicted as having various areas with different textures. For example, a central area that corresponds with instep region 33 has a first texture 46' that is generally smooth. In addition, textile element 40' includes a second texture 47' that is a plurality of longitudinal ribs. When incorporated into footwear 10, the ribs will extend longitudinally along lateral region 31 and medial region 32, and the ribs may extend into heel region 35. The ribs may be present for aesthetic purposes, or may affect the stretch properties of upper 20, for example. Accordingly, textile element 40' exhibits areas with different textures in a single element of textile material.

Many conventional articles of footwear incorporate uppers with various material elements that each exhibit different properties. For example, a first material element may be smooth, and a second material element may be textured. The first and second material elements are then stitched together to form a portion of the conventional upper. Textile element 40' also exhibits smooth and textured areas. In contrast with the conventional upper, however, first texture 46' and second texture 47' are incorporated into a single, unitary element of textile, rather than two separate elements that are stitched or otherwise joined together.

Figure 11:
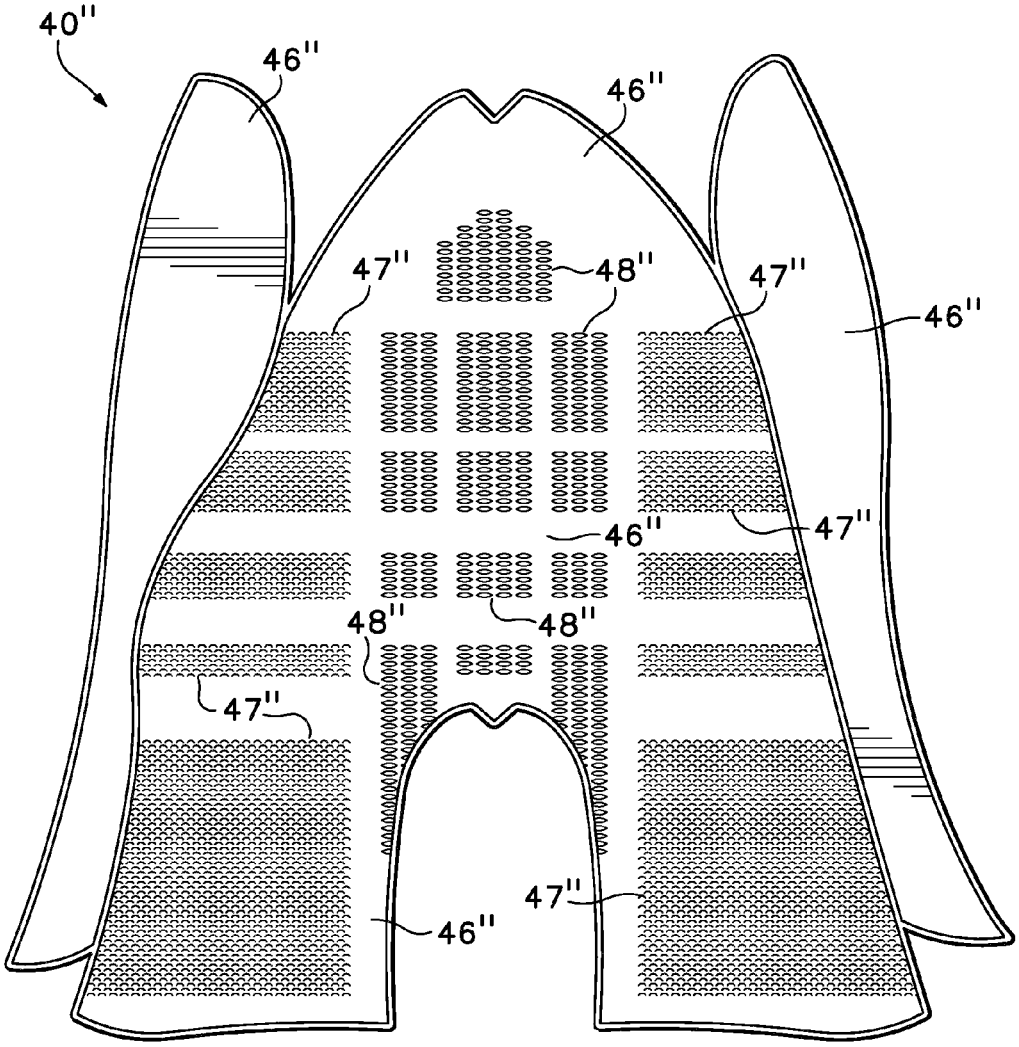
FIG. 11 is a plan view of yet another textile element.

A textile structure 40" is depicted in FIG. 11 and has the general shape of both textile element 40 and textile element 40'. Textile element 40" includes areas with three different textures. A first texture 46" is generally smooth and has the configuration of various strips that extends laterally across areas corresponding with lateral region 31, medial region 32, and instep region 33. Various portions of textile element 40" also include a second texture 47", which is generally rough in comparison with first texture 46". In addition, the area of textile element 40" corresponding with instep region 33 includes a third texture 48". The different textures 46"-48" are formed by merely varying the type of stitch formed by the wide-tube circular knitting machine at each location of textile element 40". Textures 46"-48" may exhibit aesthetic differences, or the differences may be structural. For example, the degree of stretch in areas with textures 46"-48" may be different, or the wear resistance of the areas may vary depending upon the stitch utilized. The air-permeability of textile element 40" may also vary in the different areas. Third texture 48" is formed to include a plurality of apertures that extend through textile element 40". The apertures may be formed by omitting stitches at specific locations during the wide-tube circular knitting process, and the apertures facilitate the transfer of air between the void within upper 20 and the area outside of upper 20. Accordingly, the various stitches formed in textile element 40", or one of textile elements 40 or 40', may be utilized to vary the texture, physical properties, or aesthetics of footwear 10 within a single, unitary element of material.

In addition to varying the stitch types to form textures 46'-47' and 46"-48", the type of yarn utilized in various areas of textile elements 40' and 40" may be changed to impart different properties. As discussed above, yarn may be formed from cotton, wool, elastane, rayon, nylon, and polyester, for example. Each of these yarn types may impart differing properties to the areas corresponding with textures 46'-47' and 46"-48". For example, elastane may be utilized to impart stretch, wool may be utilized for insulation, and nylon may be utilized for durability. Accordingly, different yarn types may be utilized to impart different properties. The types of knitting that may be utilized to form different zones with different properties (e.g., yarn characteristics, textures, etc.) may vary significantly to include the various warp knitting and weft knitting processes discussed earlier, such as tricot, raschel, double needle-bar raschel, circular knitting, and flat knitting, for example.

Figure 12:
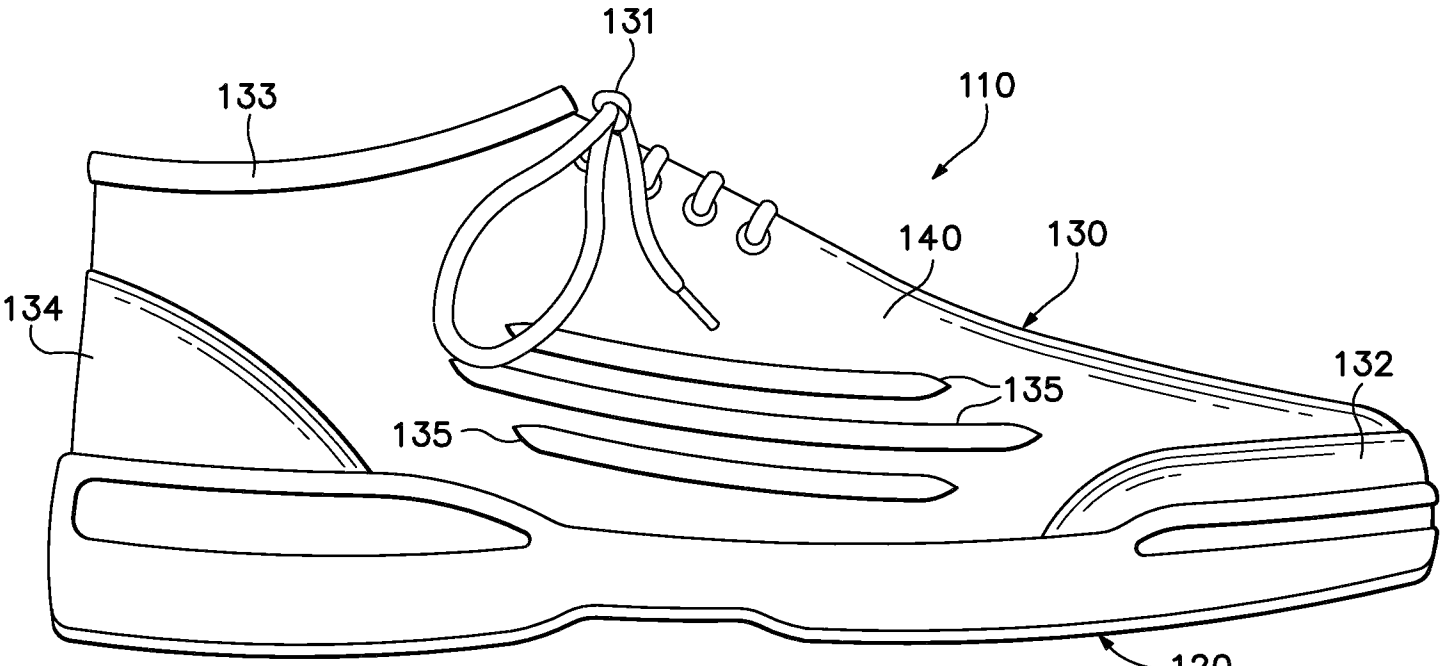
FIG. 12 is a lateral elevational view of another article of footwear having an upper in accordance with the present invention.

An article of footwear 110 is depicted in FIG. 12 and includes a sole structure 120 and an upper 130. Upper 130 includes a textile element 140 having the general configuration of textile element 40. As with textile element 40, textile element 140 forms both an exterior surface and an interior surface of upper 130. In addition, upper 130 includes a lace 131 and a plurality of elements 132-135 that also form a portion of the exterior surface. Lace 131 extends through a plurality of apertures formed in textile element 140. The apertures may be formed by omitting stitches at specific locations. Element 132 is positioned in a forefoot area of footwear 110 and may be formed of leather or rubber, for example, to provide additional wear-resistance. Element 133 extends around the ankle opening to reinforce and limit stretch in the area of the ankle opening. Element 134 extends around the heel region to counter movement of the heel and seat the heel above sole structure 120. Furthermore, elements 135 are substantially inextensible strips of material, such as leather or synthetic leather, that limit stretch on the lateral side of footwear 110. Whereas upper 30 was almost exclusively formed by textile element 40, upper 130 also includes lace 131 and elements 132-135. Accordingly, an upper in accordance with the present invention may incorporate a plurality of additional components.

Figure 13:
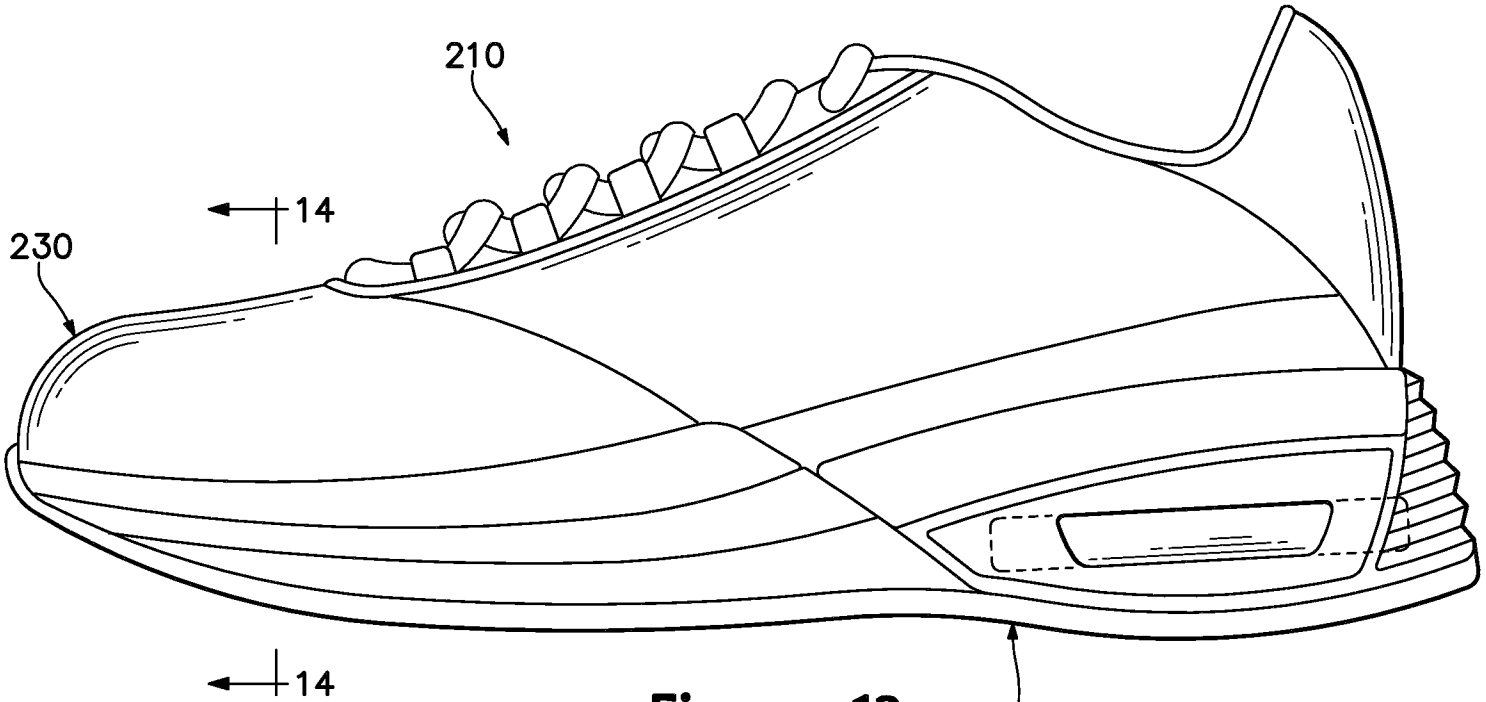
FIG. 13 is a lateral elevational view of yet another article of footwear having an upper in accordance with the present invention.
Figure 14:
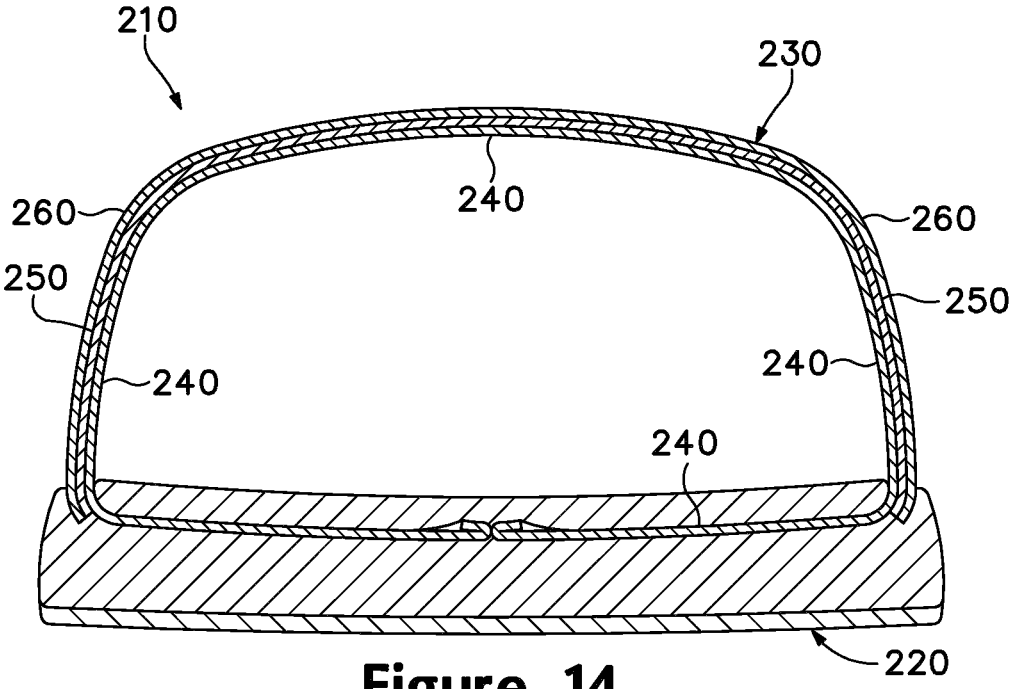
FIG. 14 is a cross-sectional view of the footwear depicted in FIG. 13, as defined by section line 14-14.

Another article of footwear 210 is depicted in FIGS. 13-14 and includes a sole structure 220 and an upper 230. Upper 230 includes a textile element 240 that forms an interior layer. In addition, upper 230 includes an intermediate layer 250 and an exterior layer 260. As discussed in the Background of the Invention section above, the upper of a conventional article of footwear may be formed from multiple material layers that include an exterior layer, an intermediate layer, and an interior layer. The materials forming the exterior layer of the upper may be selected based upon the properties of wear-resistance, flexibility, and air permeability, for example. The intermediate layer of the upper may be formed from a lightweight polymer foam material that provides cushioning and protects the foot from objects that may contact the upper. Similarly, an interior layer of the upper may be formed of a moisture-wicking textile that removes perspiration from the area immediately surrounding the foot.

Upper 230 has a configuration that is similar to the configuration of the conventional upper in that various material layers are utilized. In contrast with the conventional upper, however, the interior layer is formed of textile element 240, which is manufactured through the process discussed above. That is, textile element 240 is a single element of textile that forms the interior layer of upper 230. A benefit to utilizing textile element 240 for the interior layer is that textile element 240 includes few seams that may contact the foot. In addition, the stitches utilized at various locations of textile element 240 may modify the texture of the interior surface of upper 230, thereby limiting the degree of slip that occurs between the foot and upper 230 or enhancing the air-permeability of upper 230 in specific locations.

Various warp knitting or weft knitting processes may be utilized to form textile element 40, or the various other textile elements discussed above. An advantage of this process is that various stitches may be incorporated into specific locations of textile element 40 to modify the physical properties or aesthetics of textile element 40. Whereas a conventional upper includes various elements that stitched or adhesively joined, textile element 40 is a single, unitary element of material. From the perspective of manufacturing, utilizing multiple materials to impart different properties to an article of footwear may be an inefficient practice. By forming textile element 40 to be a single, unitary element of material, however, efficiency is increased in that upper 20 may include a single textile element, rather than numerous joined elements.

A variety of knitting processes may be utilized to form textile element 40, as discussed above. As a specific example, a jacquard double needle-bar raschel knitting machine may be utilized to form a flat textile structure, and may also be utilized to form the textile structure to have the configuration of a spacer mesh textile. Unlike textile structure 60, which exhibits a generally cylindrical configuration, the textile structure formed with the jacquard double needle-bar raschel knitting machine will have a flat configuration. Like textile structure 60, however, an outline of a textile element may be imparted to the textile structure formed with the jacquard double needle-bar raschel knitting machine. That is, differences in the stitches within the textile structure may form an outline with the shape and proportions of the intended textile element. Accordingly, the textile element may be removed from the textile structure and incorporated into footwear 10. In addition, the jacquard double needle-bar raschel knitting machine may be utilized to impart various textures, different properties, or different yarn types to the textile element. Similarly, other types of knitting, such as flat knitting, may be utilized within the scope of the present invention to impart various textures, different properties, or different yarn types to the textile element.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

What is claimed is:

1. An upper for an article of footwear, the upper comprising:

a flat knit textile element comprising (1) flat knit edges free of surrounding textile structure such that the flat knit edges are not surrounded by textile structure from which the textile element must be removed, at least one flat knit edge being a curved flat knit edge, and (2) a first knit strip having a first property and a second knit strip having a second property that is different from the first property;

wherein the first knit strip and the second knit strip are positioned adjacent to each other along one or more of a lateral side and a medial side of the upper.

2. The upper of claim 1, wherein one or both of the first knit strip and the second knit strip comprises a plurality of knit strips.

3. The upper of claim 2, wherein the first and second knit strips alternate with one another along one or more of the lateral side and the medial side of the upper.

4. The upper of claim 2, wherein the flat knit textile element comprises at least two first knit strips and at least two second knit strips.

5. The upper of claim 1, wherein the first knit strip and the second knit strip extend along the lateral side of the upper from an instep region of the upper to an area proximate to a lower region of the upper.

6. The upper of claim 1, wherein the first knit strip and the second knit strip extend along the medial side of the upper from an instep region of the upper to an area proximate to a lower region of the upper.

7. The upper of claim 1, wherein the first property comprises a first knit construction and the second property comprises a second knit construction.

8. The upper of claim 1, wherein the first property of the first knit strip comprises a smooth texture, and the second property of the second knit strip comprises a rough texture.

9. The upper of claim 1, wherein the flat knit textile element further comprises a plurality of apertures in an instep region of the upper.

10. The upper of claim 1, wherein the first property of the first knit strip comprises a higher degree of stretch than the second property of the second knit strip.

11. The upper of claim 1, wherein the second property of the second knit strip comprises a higher degree of stretch than the first property of the first knit strip.

12. The upper of claim 1, wherein the first property comprises a first yarn type and the second property comprises a second yarn type.

13. The upper of claim 12, wherein the first yarn type of the first knit strip comprises at least one of a higher biodegradability, moisture absorption, insulation, durability, and/or hydrophobicity than the second yarn type of the second knit strip.

14. The upper of claim of claim 12, wherein the first yarn type of the first knit strip comprises at least one of a higher strength, support, stiffness, recovery, fit and/or form than the second yarn type of the second knit strip.

15. An article of footwear comprising:

an upper comprising:

a flat knit textile element comprising (1) flat knit edges free of surrounding textile structure such that the flat knit edges are not surrounded by textile structure from which the textile element must be removed, at least one flat knit edge being a curved flat knit edge, and (2) a first knit strip having a first property and a second knit strip having a second property that is different from the first property;

wherein the first knit strip and the second knit strip are positioned adjacent to each other along one or more of a lateral side and a medial side of the upper; and a sole structure secured to the upper.

16. The article of footwear of claim 15, wherein the first property comprises one or more of a first knit construction and a first yarn type and wherein the second property comprises one or more of a first knit construction and a second yarn type.

17. The article of footwear of claim 15, wherein the flat knit textile element comprises a plurality of first knit strips extending along the lateral side and the medial side of the upper and a plurality of second knit strips extending along the lateral side and the medial side of the upper.

18. The article of footwear of claim 15, wherein the first knit strip is parallel to the second knit strip.

19. The article of footwear of claim 15, wherein the first knit strip and the second knit strip extend along the lateral side of the upper from an instep region of the upper to an area proximate to the sole structure.

20. The article of footwear of claim 15, wherein the first knit strip and the second knit strip extend along the medial side of the upper from an instep region of the upper to an area proximate to the sole structure.

* * * * *